US007588087B2

(12) United States Patent
Cafferata

(10) Patent No.: US 7,588,087 B2
(45) Date of Patent: Sep. 15, 2009

(54) HELICOPTER WATER BUCKET IMPROVEMENTS

(75) Inventor: Robert Cafferata, Richmond (CA)

(73) Assignee: Lois Ashford, Richmond, British Columbia (CA)

( * ) Notice: Subject to any disclaimer, the term of this patent is extended or adjusted under 35 U.S.C. 154(b) by 183 days.

(21) Appl. No.: 11/821,490

(22) Filed: Jun. 22, 2007

(65) Prior Publication Data

US 2008/0314601 A1 Dec. 25, 2008

(51) Int. Cl.
*A62C 8/00* (2006.01)
*A62C 25/00* (2006.01)

(52) U.S. Cl. ..... 169/34; 169/53; 239/171

(58) Field of Classification Search ..... 169/34, 169/51–53, 58, 67, 73; 239/171, 146, 327, 239/328

See application file for complete search history.

(56) References Cited

U.S. PATENT DOCUMENTS

| | | | | |
|---|---|---|---|---|
| 3,572,441 A | | 3/1971 | Nodegi | 169/53 |
| 3,661,211 A | | 5/1972 | Powers | 169/53 |
| 3,710,868 A | * | 1/1973 | Chadwick | 169/53 |
| 4,474,245 A | | 10/1984 | Arney | 169/53 |
| 4,576,237 A | | 3/1986 | Arney | 169/53 |
| 5,560,429 A | | 10/1996 | Needham | 169/53 |
| 5,829,809 A | | 11/1998 | Arney | 294/68 |
| 6,125,942 A | * | 10/2000 | Kaufman et al. | 169/53 |
| 6,192,990 B1 | | 2/2001 | Brooke | 169/53 |

FOREIGN PATENT DOCUMENTS

| | | | |
|---|---|---|---|
| CA | 1232889 | 7/1983 | 244/104 |
| CA | 1231311 | 8/1984 | 190/1 |
| CA | 2124166 | 5/1994 | |
| CA | 2297296 | 1/2000 | |

OTHER PUBLICATIONS

S.E.I. Industries Ltd. Bambi Bucket Operators Manual Apr. 1999 Cover Plus 4 Pages.

* cited by examiner

*Primary Examiner*—Davis Hwu
(74) *Attorney, Agent, or Firm*—Robert Cafferata

(57) ABSTRACT

A collapsible wild fire fighting water bucket made from pliable material and suspended from an aircraft to be lowered into an open body of water for filling. A weighted Rim Opening Device holds the bucket top open for filling and facilitates a tipping over action during filling. The buckets open top being free of any centrally located supports. The bucket is equipped with a tubular extension which forms a discharge port for dumping water. The tubular extension being releasably supported under water inside the bucket under tension. Purse lines running through openings in the tubular extension and resilient sealing lips bring sealing lip bulbs into abutment sealing the discharge port of the tubular extension.

Suspension lines suspend the bucket from the aircraft and a releasable support, releasably supports the free end of the tubular extension within the bucket body extending upwardly from the openings to close the discharge port. The releasable support cooperates with the openings to allow the tubular extension to be rapidly lowered so as to extend downwardly from the bottom to open the discharge port for dumping the water. The purse lines cooperate with the releasable support to lift and lower the tubular extension. The buckets also are equipped with emergency extractor Jump Seats, secured to the inside wall of the bucket to be used for dire straits emergency extraction of wild fire ground crews trapped by fire storm.

27 Claims, 12 Drawing Sheets

100
56
98
59
58
38
71
40
27
20
72

40
45
43
41
112
1114
1105
1106
1110
1133
1103
1108
1104
44
81
92
23
22
80
78
90
1111
1102
1118
1113
42
52
84
86
82
73
21
24
50
70
34
35
32
66
68
60
62
64
48
36
30
33
31
37
46
96
26
28
35
54, 55, 45
30
32
34
36

43
1133
44
23
1114
1132
1144
1144
81
22
80
1140
78
92
1132
1142
78
80
90
1107
1112
1111
1107
1100
1106
1105
1101
1102
1102
1106
1105
1104
1104
48
25
1111
41
21
42
48
1104
1104
24
24
94
1132
1113
1113
94
1110
1103
1108
74
48
76
41
1103

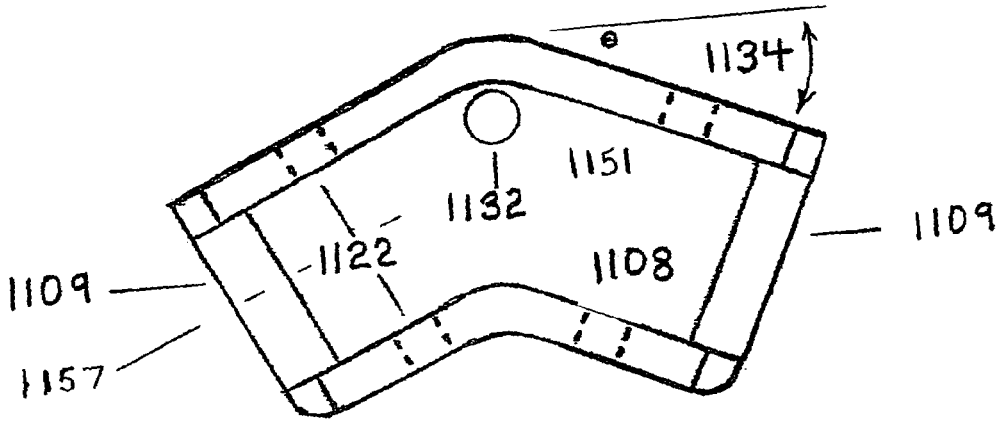
FIG. 8-A
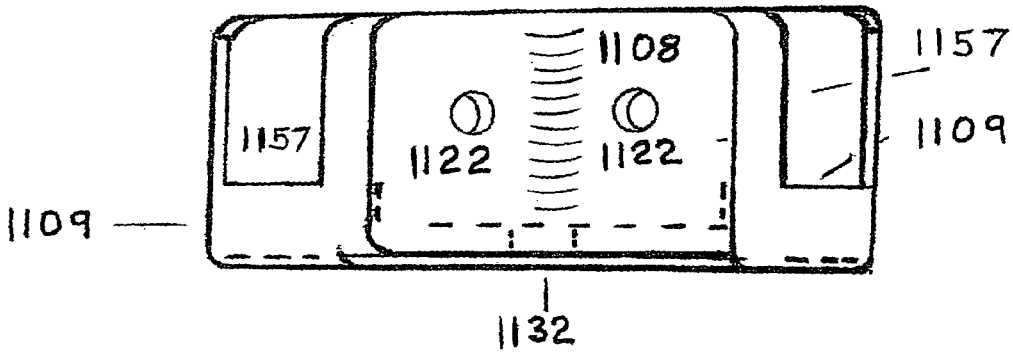
FIG. 8-B

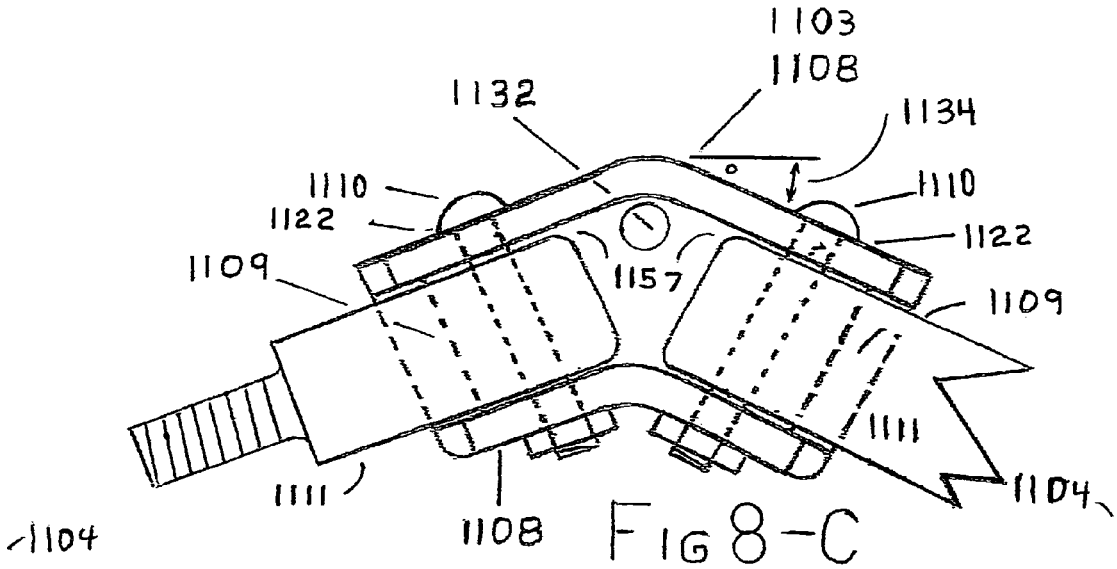
FIG 8-C
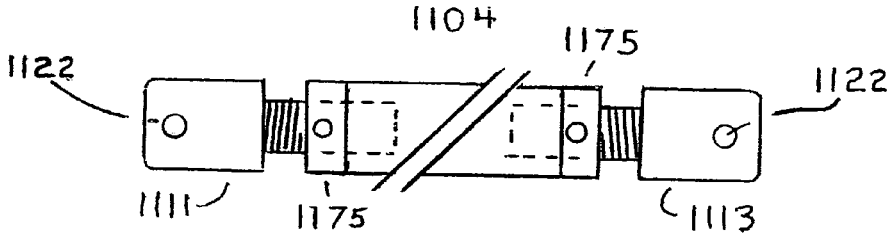
FIG 8-D

HELICOPTER WATER BUCKET IMPROVEMENTS

BACKGROUND OF THE INVENTION

1. Field of the Invention

The invention relates to a firefighting bucket assembly to be suspended from an aircraft and preferably filled from an open body of water, ie. from a lake.

2. Prior Art

From U.S. Pat. No. 3,661,211 Powers is known for a collapsible fire fighting bucket, which could be filled by immersion in a lake.

The bucket framework which supported its pliable side walls had four normally upright but collapsible supports connecting a rigid upper peripheral frame member to a ridged circular bottom. The water level being controlled by spill ports to adjust overall bucket weight to match the lifting capabilities of the aircraft. Two hydraulically operated doors released the water. When collapsed the bucket was bulky, difficult to transport, additionally the water release mechanism was heavy and expensive to manufacture. From U.S. Pat. No. 3,572,441 issued to Nodegi describes a flexible bag having a snout like flexible extension which when pulled into the bag from a line entering the top of the bag had to keep the free end of the tubular snout like extension above water. When the line was released the weight of the water inverted the tubular extension thereby releasing the water. When empty the connecting line was made to pull the extension back into the bag where a latching system held it in place.

The disadvantages of this system were the discharge port had to be held above the water level of the bag, the length of the extension caused a twisting action which could prevent dumping. In order to refill the bag it had to be transported to a filling station which resulted in loss of time increasing operational costs accordingly.

The bucket assembly described in Arney's CA 1232889 and U.S. Pat. No. 4,474,245 revolutionized aerial firefighting operations. Its simple design, lightweight, its collapsability for storage and transportation, operational superiority over prior art, has redefined aerial firefighting technologies.

Arney's invention has two bucket adjusting means which co-operate with the side wall to adjustably vary the circumference of the bucket. Firstly; bending battens inserted in pockets vertically arranged around the bucket and dimensioned apart peripherally allow the side walls to bulge outwardly to increase capacity in direct relationship to the upward force applied, allowing the operator to match the lifting capability of the helicopter to the overall weight of the bucket. This feature helped eliminate the need for spill ports utilized by Powers in U.S. Pat. No. 3,661,211 or that purpose—Secondly; independently from varing the pulling force as described above to limit bucket capacity Arney introduced an adjustable circumferential tension link. A cinch belt slidably received in belt loops around the bucket's circumference can be adjusted to limit its capacity. The operator simply adjusts bucket capacity to lifting capability of the helicopter by adjusting the cinch belt in the lockable cinch belt adjuster.

The bucket rim was stiffened by overlapping battens strung through belt loops placed around and adjacent to bucket rim. Operationally this proved to be a time consuming awkward task, begging for improvement.

Arney's improvement on Nodegi U.S. Pat. No. 3,572,441 involved sealing the discharge ports of the tubular extension when it's underwater, upright and under tension from its supporting means. Third flexible tension links, purse lines, alternately affixed through opposing resilient sealing lips closed the discharge port when under tension from the supporting tension link which is adjustably connected to the electro-mechanical control head connector which the operator utilizes to open & close the discharge port for filling and releasing water.

Needham's CA 2,124,166 and U.S. Pat. No. 5,670,429 improved the sealing lip abutment to reduce leakage caused by placing the grommets in the tubular extension adjacent to the resilient sealing lips which eliminated having the purse lines running through the resilient sealing lips, thereby eliminating abrasion to the rather soft resilient sealing lip material.

This abrasion increased the tubular extension maintenance factor. The entire tubular extension required removal from the bucket for this servicing, which in many cases required returning the bucket to the manufacturer, transportation and downtime causing additional expense.

Despite Needham's improvements to the sealing lip design further design changes could reduce water leakage through the sealing lips. One problem exists with a kink appearing in the distal end of the tubular extension when it's under tension from the second flexible link which holds the tubular extension in the underwater upright position. The kinked shape in some cases can be severe, especially if the third flexible tension links are poorly adjusted. The kinking occurs as a result of the third flexible tension links ie, the purse lines being gathered together at the terminal end of the second flexible tension link ie. in the ring to which the purse lines are adjustably connected. The purse lines fan out radially downward from the single collection point ie, the ring, to the dimensionally arranged openings in the tubular extension extending to the essentially horizontal distal ends of the tubular extension.

The outermost purse lines under tension are sharply angled upward from the outer ends of the tubular extension toward the collector ring. This generates an inwardly movement of the outermost ends of the tubular extension when under tension from the second flexible tension link, which causes the fold or kink to occur which can effect the proper alignment and abuttment of the sealing lips with potential water loss associated. Larger buckets with wider tubular extensions are more prone to this problem because the angle of the purse lines is increased accordingly at their distal ends. As the purse lines pass downwardly from the second flexible tension link ring through the hub the outermost lines become diverted by the hub increasing the angle and further developing a pronounced kink. The reader is directed to the SEI Industries Ltd. copyrighted Owners Manual produced in April 1999 which pictures both of these problems.

One objective of the Rim Opening Device invention is to reduce purse line abrasion on the sealing lips as they pass through the sealing lips similar to Arney's CA 1232889 and U.S. Pat. No. 4,474,245 submissions.

Another objective of the Rim Opening Device invention was to eliminate the central hub which diverts and increases the purse line angle to the collector ring which exacerbates the kink and potential water loss through misaligned sealing lips.

Needham's tubular extension was made narrower at its terminal end than at its base to assist the tubular extensions return to its upright position within the bucket. This change was limited to the smaller buckets only, due to the stiffness associated with smaller tubular extensions.

Larger diameter tubular extensions utilized on both medium and large buckets being more flexible were not affected, no change in the straight diameter design was required.

Another objective of the Rim Opening Device invention is to make the tubular extensions more flexible to assist the tubular extension's return to its upright position within the bucket.

The aerial firefighting condition can aggressively subject the aerial firefighting bucket to physical damage. Ideally the bucket is allowed to submerge in an open body of water for filling purposes.

The operators often find it necessary to scrounge water from any available source ie, shallow ponds, creekbeds, rivers, etc. where all manner of conditions and debris can inflict damage to the bucket. A typical example would be dragging the bucket along a shallow creekbed or river filled with sharp rocks, gravel, mud, uprooted trees, etc. This subjects the buckets upper rim, side walls & bottom of the bucket to aggressive abrasion, which can cause ripping and tearing of the pliable material. It has been found that both debris and bucket suspension lines can get entangled and hung up on the centrally located hub and spoke Rim Opening Device, resulting in lost time to land and re-configure lines and remove debris.

Other damage can occur in operational conditions such as impact, hard landings, hangups, emergency release of entire bucket when snagged or hung up.

It's just the nature of the business, however; design changes can mitigate physical damage to the aerial firefighting bucket.

Another objective of the Rim Opening Device invention is to totally eliminate the hub and spokes or any structural members centrally located within the bucket, producing a collapsible bucket with a centrally open orifice.

The central hub and spoke rim opened device which Needham describes in CA 2124166 and U.S. Pat. No. 5,560,429 can prove to be difficult to deploy on the larger buckets which are constructed of heavier, stiffer materials than their smaller counterparts.

The operator must muscle the hub & spoke rim opener into the overcenter position by fighting the stiff action and tight-fitting device past center. It is sometimes necessary to utilize a lever to pop it center, when it does so it either quickly jumps out at you or plunges inward, care must be taken in its deployment.

Needham also describes in Claim 7 and lines 38 et., of column 4 of the Detailed Description in the above noted patents, a Rim Opening Device. It comprises of a hollow hub centrally located and having a plurality of spokes which have their inner ends hinged from the central hub. They extend radially with their outer ends hinged adjacent the bucket rim and cooperating with the side wall to open and close the bucket somewhat like an umbrella. The spokes being dimensioned such as to allow an overcentering of the hub and spokes slightly above the bucket rim elevation. This device marked a significant improvement over Arney's upper rim stiffening batten system as described in this CA 1232889 and U.S. Pat. No. 4,474,245. However the umbrella like hub and spoke device is not without shortcomings.

Another objective of our Rim Opening Device invention is to improve not only the deployment and collapsibility of the bucket but also operational safety while undertaking these activities in the field of operations.

Needham's bucket mouth held open by a hub and spoke apparatus was a great improvement over the prior art of the time. The distal ends of the spokes dimensionally connected around the rim provide rim support at the connection point which assists the immersion process. However, Needham's bucket has some tendency to float on the surface prior to immersion. There are two reasons for this phenomenon, firstly; the rim is made of quite flexible material and is not supported between the distal ends of the spokes to which it is connected, the flexible material is pushed upward upon laying down rather than quickly penetrating the surface, secondly; both Arney's and Needham's tipping weight systems connects weight shot bags or blocks to the shell of the bucket, somewhat below the rim, their weight distending the shell curvature when laid horizontally on the water. The distended shape forms a shallow hull which promotes floating not submersion slowing the filling process.

Another objective of our Rim Opening Device invention was to truly achieve rapid submersion and filling, overcoming the above noted phenomenon by re-enforcing the rim, buttressing the rim circumferentially and by concentrating the tipping weights right at the rim not below it to achieve this objective.

A significant problem exists with Needham's CA2,124,166 and U.S. Pat. No. 5,670,429 umbrella-like bucket opening device which is water loss out of the bucket during flight. Water loss being caused by a constant undesirable flexing of the bucket shell, a repetitive in and out action generated at the bucket's rim, but transferred throughout the entire bucket disturbing the contained water, and transmitting a harmonic vibration that can sometimes be felt all the way up to the helicopter.

Both the deployment cable that lifts the hub into the operational position and the bucket's suspension lines are under tension from the electro-mechanical control head connector to which they are dually attached. Now the overcentered centrally located hub radially connects the distal ends of the inclined spokes to the perimeter of the bucket shell.

As the prior art bucket moves at speed through the air it is buffeted about and disturbed in flight which causes a back and forth transfer of weight on and off the hub. As the tension on the hub abruptly drops so does the hub, only to be violently jerked back up again; up-down, up-down, over and over again generating an undulating pulsing action.

As the centrally located hub radially connects the spokes to the bucket rim the up and down movement described above causes the perimeter of the bucket rim to move in and out, over and over again. Over time the rotatably connected spokes, brackets and hub connections become worn; holes elongated, oscillated especially when hollow spokes are utilized, the worn parts co-operate to increase the intensity of the undesirable pulsing and harmonic vibrations.

Additionally, because the overcentered hub and upper portions of the inclined spokes are positioned above the bucket's rim they collide with high speed air during flight, redirecting or deflecting the turbulent air into the mouth of the bucket colliding with the agitated water (provoked by the pulsing, undulating, harmonic vibrations) to generate a spray of water out of the bucket, much like a gale force wind will blow the top of a whitecap at sea. The design and positioning of the umbrella like device propagates water loss out of the bucket during flight.

Other objectives of our Rim Opening Device Invention is to create a bucket with superior air flow characteristics which would reduce water loss, eliminate vibrations, pulsing and surging, in general produce superior inflight characteristics which help reduce pilot fatigue.

Another objective of this invention was to provide a simple, inexpensive secondary discharge tube which could be utilized by ground crews to manually fill back packs, water storage bags, small tanks, from a bucket slung from under the helicopter. Currently, there are two methods which this writer is familiar with.

1. an expensive pump system operated by ground crews.
2. a rotatable stiff tube corrected to a through hull rotatable bulkhead fitting the tube extending above the bucket rim when in the upright position, and connected thereto by a quick connector.

Our objective would provide a dual purpose secondary discharge hose, one which is sufficiently flexible to eliminate the need for a rotatable fitting. Additionally, the operator can vary the bucket's capacity by variably connecting the distal end of the hose below the rim on smaller wild fire buckets, eliminating the need to choke the bucket with a cinch strap, which is currently the method. Effectively, this system of adjusting the bucket's capacity is functional for smaller wild fire buckets only, due to the longer drain down time required for larger buckets. This system would be beneficial to buckets such as the 80-90-100-120 gallon variations where 10-30% drain down times are operationally satisfactory.

Another specific objective of this invention was to improve the servicing of the valve in addition to the bucket's general serviceability. A worst case scenario would be removing a damaged valve during field operations. Two factors make this service operation very difficult on prior art buckets. Firstly; the entire umbrella-like bucket opening device, the central hub, spokes, restrainer cable, and deployment cable must be removed to gain access into the bucket to remove the valve's circular ring of fasteners The valve is firmly sealed with butyl tape, bonding the valve collar's resilient material to the bucket shell, Removing the valve, breaking the butyl bond is not only difficult but messy, the butyl compound sticking to anything it touches. Most often breaking this bond results in ripping chunks out of the valve's resilient sealing collar, with some portions remaining adhered to the shell of the bucket. The torn out chunks of the resilient sealing valve collar must be removed, the butyl compound removed and replaced before the new valve can be installed; it's a messy and difficult operation. After the new valve has been installed, the central hub, spokes, restrainer cables and bucket deployment cable must now be re-installed.

The centrally open top of our "Wild Fire Bucket" invention, resolves the first difficulty, while the valve sealing resilient collar's design and installation resolves the latter. The improvement being a two piece sealing device each having a resilient collar. The bottom collar is sealed to the bucket shell in the traditional manner with a butyl type compound, while the upper collar is permanently attached to the valve body. A ring of fasteners bring the collars into sealing abuttment. Removing this type of valve is a simple matter. It's done without disturbing the butyl seal which remains firmly in place during the procedure. The valve can now be replaced by simply turning the bucket upside down and reaching into the bucket. No longer is it necessary to climb into the bucket to change a valve. The new design resolves a long standing service issue.

Another servicing problem exists with Prior Art Buckets, when seriously damaged, the bucket shell or body requires opening it up and cutting out ripper, torn, holed, or otherwise damaged panels for their replacement. To do this requires removing the valve from the bucket. Our design improvement now once again allows the valve to be easily removed without damage. Now, the resilient sealing collars have a fabric cover which protects their soft resilient sealing material. The lower collars can be removed from the bucket's shell or body without being torn or damaged by the butyl sealing compound which resists the removal. The covering saves the lower collar under this servicing.

On occasion water bucket equipped helicopters are dispatched to transport emergency supplies to "Wild Fire Ground Crews", i.e. back packs, tools and equipment, potable water, first aid supplies, emergency heat shield blankets and bags, etc. Water buckets equipped with constricting hubs and spokes require precious time to stuff the cargo in and through the narrow spaces between the hub and spokes but even more time, sensitive life threatening time, to arduously retrieve the previous cargo under extreme operational conditions.

Another objective of our Rim Opening Device Invention was to design the bucket mouth centrally open, free of obstructions facilitating efficient emergency cargo transport.

However, the single most significant aspect of a centrally open bucket mouth—bar none—is the bucket's emergency adaptability to extract "Wild Fire Ground Crew" Personnel from harms way. Trapped and encircled by a fire storm, it literally becomes a dire straits emergency life saving platform, the centrally open mouth providing firefighting ground crew emergency access into the bucket for safe extraction. Never in the history of collapsible water bucket design and technology has this life saving feature been obtainable.

SUMMARY OF THE INVENTION

The invention reduces the difficulties and disadvantages of the prior art by providing an aerial fire fighting bucket to be equipped with a Rim Opening Device which has its open top free of centrally located hubs and spokes which extend radially therefrom to the walls of the bucket. Suspension lines and support cables can on occasion becoming entangled therein. The Rim Opening Device of this invention being a horizontally arranged closed plane, preferably in the form of a closed plane polygon, becomes a circumferential structural member which reinforces the bucket rim from body impact and hazardous operational conditions. This invention, Rim Opening Device, utilizes heavier components on one side of the bucket than on the other side, ie, Brass $V/_S$ Aluminum. The differing structural shapes and specific gravity quotions provide sufficient weight differential to provide an offsetting tipping action. Bulky weights bolted to the side wall of the bucket, which is the case with prior art, can cause air flow disturbances, suspension line entanglements and leakage. The Rim Opening Device aerodynamics positioning within the bucket adjacent the rim does not deflect and re-direct high speed airflow into the bucket generating water loss as is the case with prior art hubs and spokes which protrude above the bucket rim. Prior art difficulties with abrasion on the resilient sealing lip material caused by purse line travel has been substantially reduced by providing a conformable abrasion cover to the upper portion of the sealing lips above and below the essentially centrally located purse line passageways. However, it is the redesigned shape of the sealing lip portions located below the centrally located purse line passageway through the resilient sealing lips which is the essence of the sealing lip improvement. Sealing lip bulbs have been added to that portion of the sealing lips.

When under tension from the purse lines and hydrostatic pressure acting on the tubular extension it straightens out pushing its outward distension caused by the sealing bulbs to push against the sealing bulbs to improve the sealing abutment The bulbs under purse line tension and hydrostatic pressure acting on the tubular extension become compressed and elongated to provide an improved sealing abutment.

Figure 1:
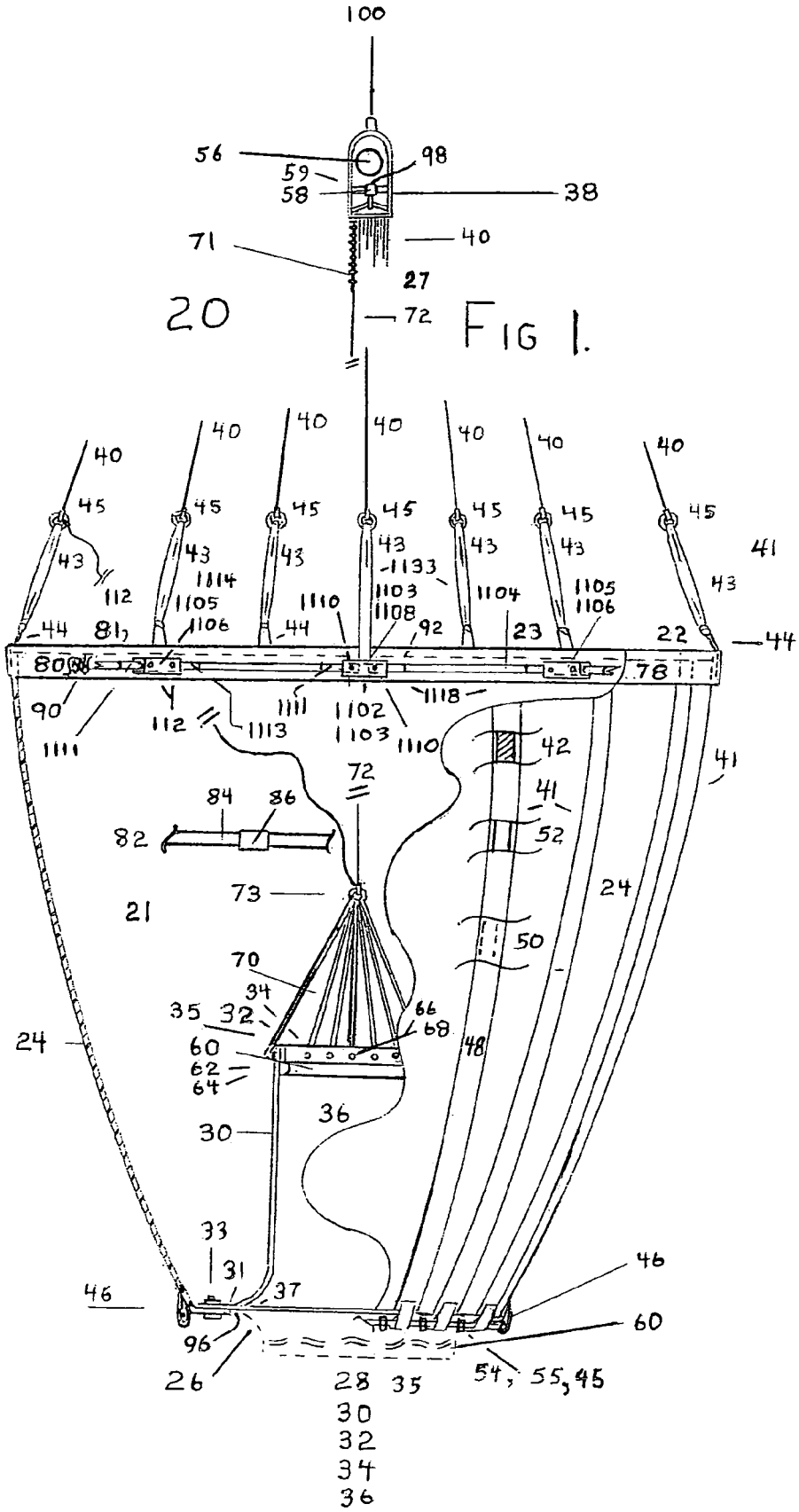
FIG. 1

Is a side elevation of a complete bucket, partially sectioned and fragmented, means of suspension and control, a portion of the dump valve in the fully retracted closed position, in full outline and fragmented in broken outline in the open extended or discharge position, a section of the Rim Opening Device with its lifting strap, first, second and third circumferential tension links, and first, second and third tension links in fragmented and sectional outline.

FIG. 2

Is a top plan view of a fully deployed Rim Opening Device equipped fire fighting bucket complete with a second circumferential tension link in full outline, a sectioned second flexible tension link and a complete third flexible tension link connected to a fully retracted closed tubular extension fastened to the bucket body, cables and suspension lines and releasable support being omitted for clarity.

FIG. 3

Is a diagrammatic side elevation of a bucket body panel with first, second and third circumferential tension links, first flexible tension link extension and connection means. The side wall panel strip, webbing belt and batten pocket are shown fragmented in broken lines and the mechanical wishbone abrasion cover in full outline.

FIG. 4

Is a diagrammatic sectional side elevation of a Rim Opening Device outlining a complete wishbone, partially opened.

FIG. 5

Is a top plan view of the Rim Opening Device and bucket rim outline showing transitional development from the fully collapsed state centrally positioned therein, to the second and third stage full development.

FIG. 6

Is a diagrammatic end view elevation of a sectioned pair of sealing lips, sealing bulbs, and the distension of the tubular extension around the sealing lip bulbs prior to tension from the third flexible tension link being applied.

FIG. 7-A

Is an end view of a round shaped trimming weight affixed to a mechanical wishbone arm.

FIG. 7-B

Is a side elevation of a round shaped trimming weight affixed to a mechanical wishbone arm.

FIG. 8-A

Is a top plan view of the free end connector shown in full outline, fragmented lines indicating fastener holes for connecting mechanical wishbone arms, not shown, the angle of inclination being depicted with a curved arrow.

FIG. 8-B

Is a diagrammatic side elevation in full outline of the free end connector, with passageways for free end rotatable fasteners to connect the mechanical swing arms in the connector swing arm tract.

FIG. 8-C

Is a diagrammatic plan view of the free end connector showing the angle of inclination, connector swing arm tract and left hand adjusters, lifting cord passageway and free end rotatable fasteners.

FIG. 8-D

Is a sectioned side elevation of a mechanical swing arm depicting both right and left hand adjusters to variably adjust its length.

FIG. 9

Is a side elevation of an extractor jump seat affixed to the interior of a Wild Fire Fighting Water Bucket side wall.

FIG. 10

Is a fragmented side view of a Wild Fire Fighting Water Bucket with an exploded view of the tubular extension and the lower sealing collar, and the flexible discharge hose.

FIG. 11

Is a fragmented side elevation of a prior art tubular extension installation in a Wild Fire Fighting Bucket.

DETAILED DESCRIPTION

FIG. 1

The, Wild Fire Fighting Water Bucket 20, has a Bucket Body 21, made of tough pliable material, and has a Rim 22, which defines the Mouth 23 and the Centrally Open Top 1114, which facilitates filling from an open body of water, ie. by dipping into a lake. The, Wild Fire Fighting Water Bucket 20, has a Sidewall 24, extending downwardly from the Rim 22, and a Bottom 26, cooperating with the Sidewall 24, and having an Opening 28. A, Tubular Extension 30, made of pliable material is shown in a retracted position extending upwardly into the Wild Fire Fighting Water Bucket 20, from the Opening 28, in the Bottom 26, and the Free End Of The Tubular Extension 32, formed into a Discharge Port 35, to serve as the Dump Valve 36. In FIG. 1, the Tubular Extension 30, is shown fragmented in full outline in the retracted or raised position, and is also partially shown in the broken outline in an extended or lowered position, extending downwardly from the Wild Fire Fighting Water Bucket 20, with the Dump Valve 36, open to permit the discharge of water.

The Wild Fire Fighting Water Bucket 20, assembly also includes the Harness 27, for suspending the Wild Fire Fighting Water Bucket 20, from a helicopter Support Line 100, the Harness 27, comprising Control Head Connector 38, which also serves as a connector for connecting to the helicopter (not shown), and connecting a plurality of First Flexible Tension Links 40, which function as suspension lines, and for releasably connecting to the Second Flexible Tension Link Adjuster Chain 71, which functions as a adjustable extension for the Second Flexible Tension Link 72, which functions as a trip line for discharging water.

The Control Head Connector 38, also serves to releasably support the Second Flexible Tension Link 72, by means of a Spring Reel 56, and a Trip Mechanism 58, which is remotely controlled by activating an Electric Solenoid 59, to selectively hold or release the Second Flexible Tension Link 72, and Electric Cord 98, is connected to the helicopter which supplies the required electric current to control loading and discharging water.

Figure 4:
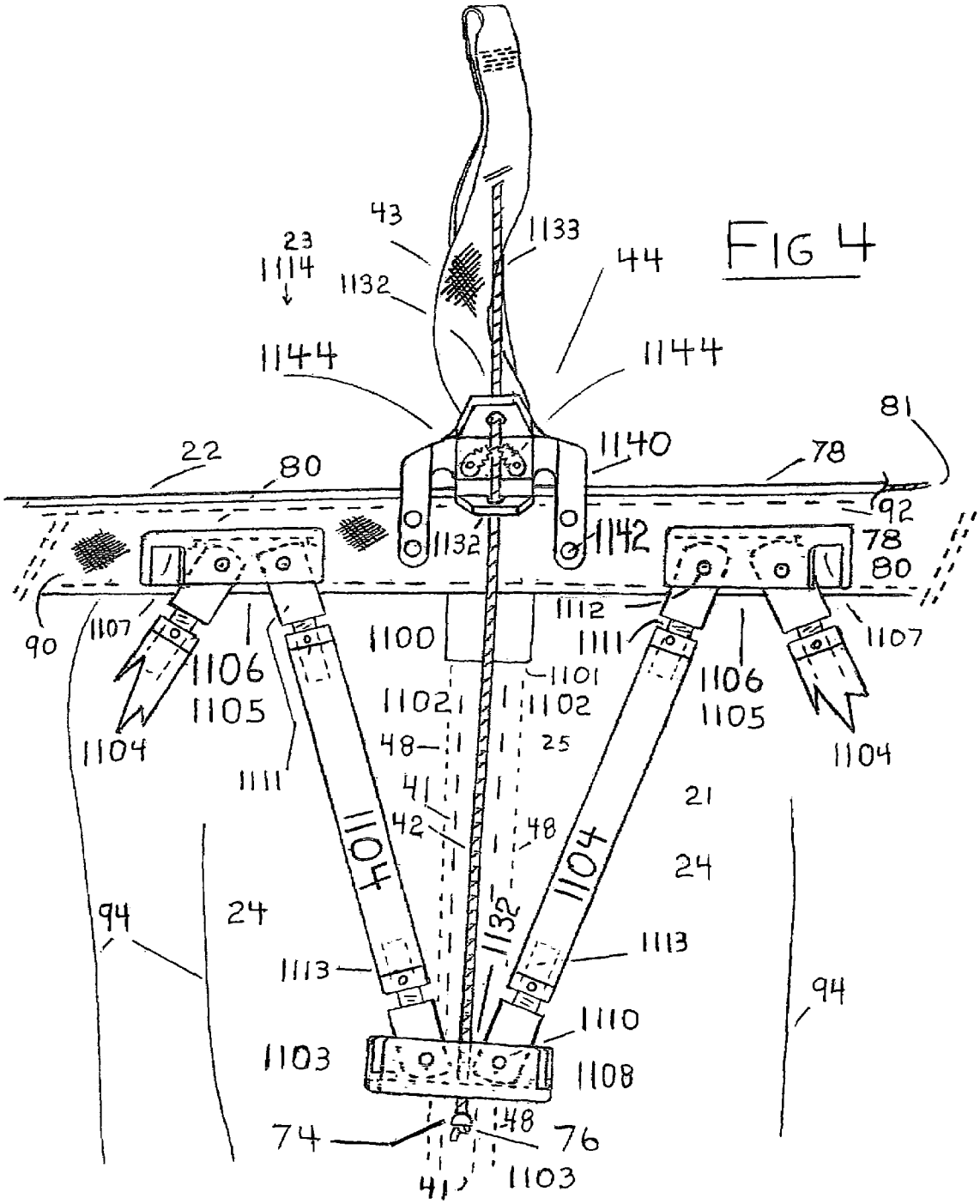

FIGS. 1 and 4

The Harness 27 also includes a plurality of Lifting Cords 1133, FIG. 4, (hidden from view FIG. 1) connected to cooperate with the Free End Of Mechanical Wishbones 1103, FIG. 4 of the Rim Opening Device 1100, the Lifting Cord 1133, being attached to the Connector Shackle 45, in such a manner that the First Flexible Tension Link 40, receives the weight of the Wild Fire Fighting Water Bucket 20, and it's water cargo rather than the Rim Opening Device 1100, or it's Lifting Cord 1133.

Figure 3:
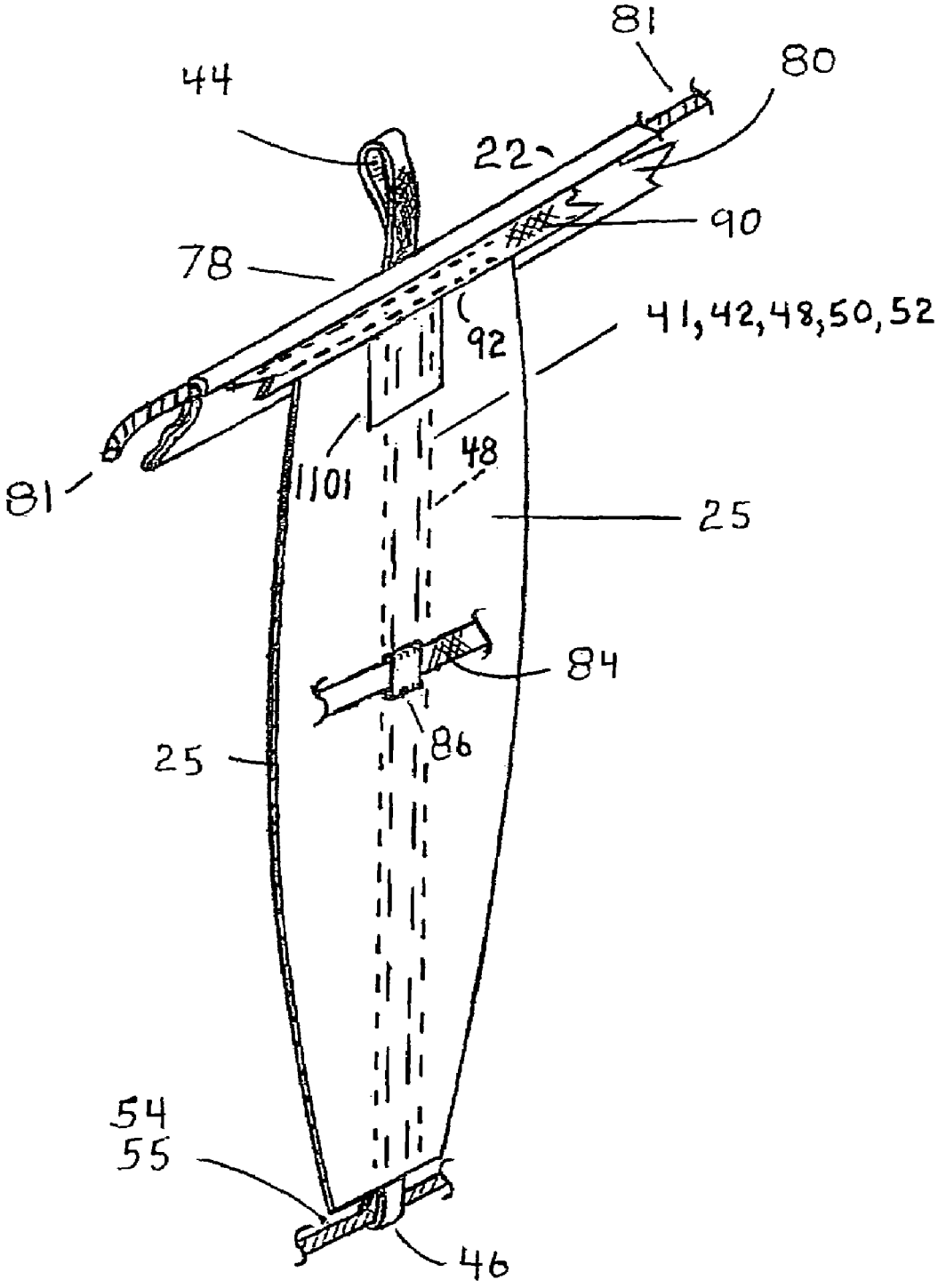

FIGS. 1, 3 and 4

The plurality of the First Flexible Tension Links 40, extend downwardly from the Control Head Connector 38, to be connected to the First Flexible Tension Link Extension 41, comprising of a Connector Shackle 45, which connects the Connector Strap 43, thereto. The Connector Strap 43, is choke connected to the Upper Connector Loop 44, a loop sewn into a Webbing Belt 42, which is sewn to a Sidewall Panel Strip 48, which is dialectrically welded to the Side Wall Panel 25, this process creates a Batten Pocket 50, into which a Batten 52 is latterly inserted. The Webbing Belt 42, exits the lower end of the Batten Pocket 50, and is formed into the Lower Connector Loop 46.

The Side Wall Panels 25, also being dialectrically welded together creating both the Side Wall 24, and the Bucket Body 21. The Lower Connector Loops 46, cooperate with the Third Flexible Circumferential Structural Link 54, to circumferentially receive a Chain 55, which is tensioned to partially support the weight of the Wild Fire Fighting Water Bucket 20, and it's water cargo.

Figure 2:
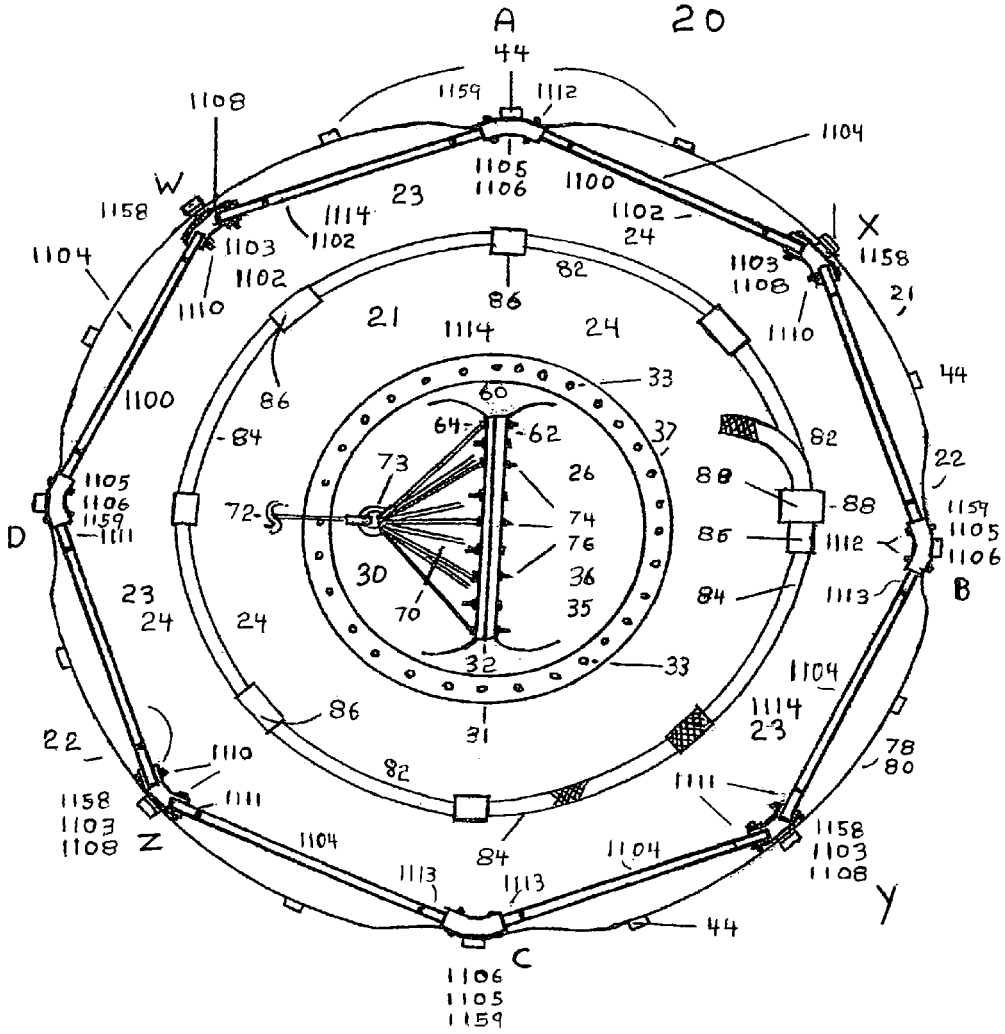

FIGS. 1 and 2

The Second Flexible Tension Link 72, is releasably connected to the Control Head Connector 38, by means of the Second Flexible Tension Link Adjuster Chain 71, its main purpose is to properly tension and vertically adjust the height of the Tubular Extension 30, when it's upright and underwater, within the Wild Fire Fighting Water Bucket 20. Adjusted and tensioned the Second Flexible Tension Link 72, which functions as a trip line, extends downwardly from the Connector Head 38, to be connected to the Third Flexible Tension Link 70, by means of a Connector Ring 73. The Third Flexible Tension Link 70, functions as a plurality of purse lines utilized to seal and/or re-seal the Tubular Extension 30 when under tension. The, Tubular Extension 30, functioning as a Dump Valve 36. The, Tubular Extension 30, installation in the Bucket Body 21, differs significantly from that of prior art installations FIGS. 10 and 11. The design modifications greatly improve the servicing and or replacement of the Tubular Extension 30, within the Bucket Body 21.

Figure 6:
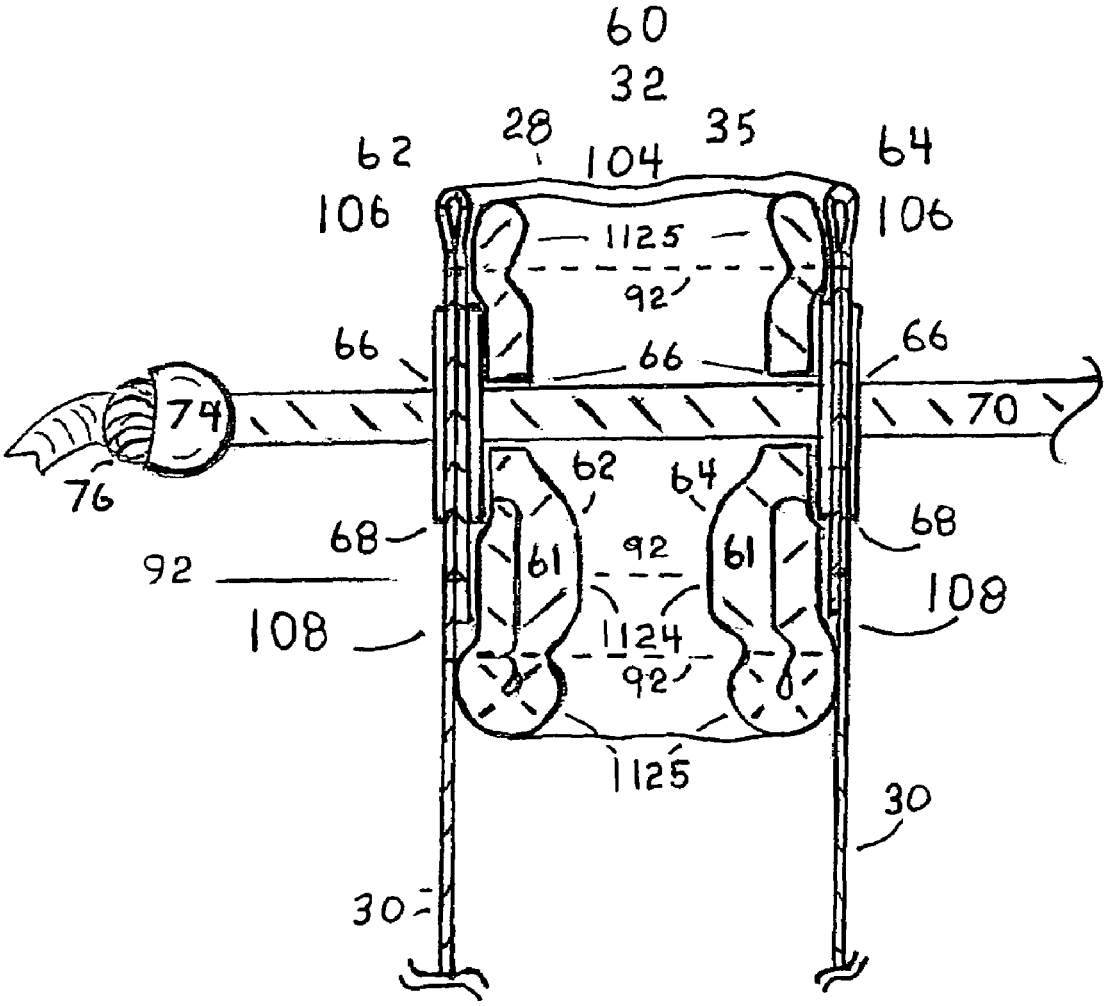

FIGS. 1, 2, and 6

The, Free End Of Tubular Extension 32, has an Opening 28, formed into a resealable Discharge Port 35, which has a Sealing Lip 60, extending circumferentially there around to form two opposing sealing lip portions, FIGS. 1 and 6, the Front Sealing Lip 62, and the Opposite Sealing Lip 64, which are brought into sealing engagement with each other for minimizing water leakage from the Tubular Extension 30.

FIGS. 1, 2 and 6

The, Tubular Extension 30, has a plurality of Openings 66, reinforced with Grommets 68, the Openings 66, in the Tubular Extension 30, are aligned with a corresponding plurality of centrally placed Openings 66, through the opposing sealing lips, ie, the Front Sealing Lip 62, and the Opposite Sealing Lip 64, which cooperates with the Third Flexible Tension Link 70, ie, the plurality of purse lines, in a straight line downwardly from the Second Flexible Tension Link 72, (as compared to prior art hubs which divert the lines causing their tubular extensions to be kinked which promotes leakage from their tubular extension).

FIGS. 1, 2, and 6

The, Third Flexible Extension Link 70, which functions as a plurality of purse lines enter the Tubular Extension 30, passing through both sides of the Tubular Extension 30, and through the Openings 66, in both sealing lips ie, the Front Sealing Lip 62, and the Opposite Sealing Lip 64, terminating in a Ball Stop 74, FIG. 6, secured to the terminal end of the Third Flexible Extension Link 70, with a Knot 76. A Tubular Extension Restrainer 112, shown in FIG. 1, is a line which runs downwardly from the First Flexible Tension Link 40, i.e. the Connector Shackle 45, to be connected to the Second Flexible Tension Link 72, Connector Ring 73, its purpose is to limit Tubular Extension 30, travel.

FIGS. 1 and 6

A, Tubular Extension Fold Over 106, at the Free End Of Tubular Extension 32, forms an Opening 28, which functions as a Discharge Port 35, in the Tubular Extension 30, which functions as a Dump Valve 36. The, Tubular Extension Fold Over 106, locates the Distal End Of The Tubular Extension 104. The, Terminal Edge Of the Tubular Extension Fold Over 108, is sewn to the side wall of the Tubular Extension 30, by Stitching 92. The soft resilient opposing sealing lips, ie, the Front Sealing Lip 62, and the Opposite Sealing Lip 64, are pierced with a plurality of Openings 66, which aligned with the plurality of Grommets 68, in the Tubular Extension 30, through which the Third Flexible Tension Link 70, purse lines, cooperate. A Ball Stop 74, being located on their terminal ends, and secured by a Knot 76, to provide an end stop which cooperates with the side wall of the Tubular Extension 30, to limit purse line travel; and applies pressure, compressing the Sealing Lips 60, when under tension from the Third Flexible Tension Link 70.

The Sealing Lip 60, extends circumferentially around the inside of the Tubular Extension 30, adjacent to the Distal End Of The Tubular Extension 104, to form two opposing sealing lips, the Front Sealing Lip 62, and the Opposite Sealing Lip 64. A single layer of Resilient Sealing Lips material, a soft, resilient, neoprene foam having an Abrasion Cover 1125, to reduce Third Flexible Tension Link 70, purse line abrasion is sewn to the Tubular Extension 30 by a single row of Stitching 92 below the Tubular Extension Fold Over 106.

The sealing portion of Sealing Lip 60, is that portion which is below the Opening 66 in the Grommets and that which pierces the Sealing Lip 60, which is folded over a sufficient number of times towards the side wall of the Tubular Extension 30, to produce the resilient Teardrop Shaped Sealing Bulb 1124, FIG. 6 shows a single fold over for clarity purpose, but the multiple fold overs may be required, depending on the thickness of the soft resilient neoprene foam to produce the Teardrop Shaped Sealing Bulb 1124, which is thinner on the top than on the middle or at the bottom. The lower portion thereof is Stitched 92, to the side wall of the Tubular Extension 30. The Teardrop Shaped Sealing Bulb 1124 having greater compression and greater sealing resilience than the flat surfaces of prior art sealing lips.

FIG. 2

FIG. 2 is a plan view perspective of the Wild Fire Fighting Water Bucket 20, looking downwardly there into. It has a tough pliable Bucket Body 21, a Side Wall 24, extends circumferentially there around to form the vessel. The, Bucket Body 21, has a circular Opening 28, (not visible), formed there around the distal end of the Side Wall 24, to which the circularly shaped Bottom 26, is attached. It takes the form and shape of a Tubular Extension 30, which functions as a Dump Valve 36. It is displayed withdrawn, upright within the Wild Fire Fighting Water Bucket 20, and having the Third Flexible Tension Links 70, skewed to one side for purpose of clarity.

The Second Flexible Tension Link 72, which functions as a trip line is releasably supported by the Control Head Connector 38, FIG. 1, which selectively applies tension on the Connector Ring 73, and the Third Flexible Tension Link 70 (purse lines) which are displayed skewed to one side for clarity purposes, FIG. 2. The Third Flexible Tension Link 70, (purse lines), alternately enter opposite sides of the Free End Of Tubular Extension 32, passing through the opposing sides of the Sealing Lip 60, ie, the Front Sealing Lip 62, and the Opposite Sealing Lip 64, and terminating their distal ends with a Ball Stop 74, and a Knot 76, FIG. 6. The Free End Of Tubular Extension 32, forms a Discharge Port 35, for releasing water from the vessel when tension on the Second Flexible Tension Link 72, is released.

The, Tubular Extension 30, has a Fixed End Of Tubular Extension 37, which is secured to the distal end of the Side Wall 24 of the Bucket Body 21, and has a Tubular Extension Mounting Flange 31, and a circular ring of Tubular Extension Fasteners 33, which make the connection thereto. When the Control Head Connector 38, FIG. 1, selectively releases tension on the Second Flexible Tension Link 72, the weight of the water rapidly plunges the Tubular Extension 30, out the Opening 28 in the Bottom 26, unloading the water out through the Discharge Port 35. When empty, tension on the Second Flexible Tension Link 72, supplied by the Spring Reel 56, returns the Tubular Extension 30, to the upright position within the Wild Fire Fighting Water Bucket 20.

The Third Flexible Circumferential Structural Link 54, the Chain 55, extends around the Bottom 26, threaded through the Lower Connector Loops 46, to be adjustably connected and tensioned to partially support the weight of the Wild Fire Fighting Water Bucket 20, and it's water cargo, FIG. 1. The off center weight of the Rim Opening Device 1100, which is heavier on one side than the other, causes the Wild Fire Fighting Water Bucket 20, to unbalance, falling over on it's heavier side so as to rapidly immerse the Rim 22, and the Mouth 23 below the surface which facilitates filling. The Second Flexible Circumferential Structural Link 82, provides a means to variably adjust the capacity of the Wild Fire Fighting Water Bucket 20, a Cinch Strap 84, FIGS. 1 and 2, circumferentially arranged around the inside of the Bucket Body 21, is slideably received through a plurality of Cinch Strap Loops 86 attached midway up the inner Side Wall 24. A, Buckle 88, secures the terminal end of the Cinch Strap 84. The, Cinch Strap 84, is utilized to vary the size of the Wild Fire Fighting Water Bucket 20, carrying capacity to match the capability of the Helicopter or other operating conditions such as elevation.

FIGS. 2 and 4

The primary focus of this invention is a Rim Opening Device 1100, which opens the Wild Fire Fighting Water Bucket 20, concentrically and circumferentially without utilizing structural members such as hubs and spokes which restrict the interior of the Bucket Body 21. The, Rim Opening Device 1100, produces a Centrally Open Top 1114, and Mouth 23, are free of cumbersome internal bracing, providing clean access into its interior for servicing components such as the Tubular Extension 30, or unrestricted loading-unloading of general cargo which prior art collapsible buckets are incapable.

The Rim Opening Device 1100, preferably has a plurality of interconnected Mechanical Wishbones 1102, a minimum of three are required. A device having independent wishbones attached to the Bucket Body 21, could be made to work, however it has several negative embodiments. FIG. 2, shows a Rim Opening Device 1100, which has four interconnected Mechanical Wishbones 1102, and this description will focus on that configuration.

In FIG. 2 the Wild Fire Fighting Water Bucket 1100, with four interconnected Mechanical Wishbones 1102, has four Fixed End Connectors 1106, i.e. 1159, Fixed End of Mechanical Wishbone, Connector Points A, B, C, and D affixing the Fixed End Of Mechanical Wishbones 1105, adjacent the Rim 22, of the Bucket Body 21, and four Free End Connectors 1108, i.e. 1158, Free End of Mechanical Wishbone, Connector Points W, X, Y, and Z co-joining the Mechanical Swing Arms 1104 and the Free End Of Mechanical Wishbones 1103. The interconnected Mechanical Wishbones 1102, share one half of each adjoining Fixed End Connector 1106, which cooperate with each other, and their Mechanical Swing Arms 1104, FIG. 4, being rotatably affixed to the Fixed End Connector 1106 by means of a Fixed End Rotatable Fastener 1112, their Mechanical Swing Arms 1104, extending therefrom to be received by the Free End Connector 1108, and rotatably affixed thereto by the Free End Rotatable Fastener 1110. Both the Fixed and Free End Rotatable Fasteners 1112 and 1110, are longitudinally round fasteners such as nut and bolt or a pin and retainer, refer to FIGS. 4 and 8*c*. Each, Mechanical Swing Arm 1104, which functions as a threaded turnbuckle, have both a Left Hand Adjuster 1111, on one end and a Right Hand Adjuster 1113, on the other end, and are tensioned to a close fit within and adjacent the Rim 22. A, Lock Collar 1175, acts to secure same.

FIGS. 1 and 4

The upper end of Lifting Cord 1133, is adjustably connected to the First Flexible Tension Link 40, (suspension line) Connector Shackle 45, which also connects the Connector Strap 43 which is choke connected to the Upper Connector Loop 44 FIG. 1, to receive the weight of the Wild Fire Fighting Water Bucket 20, and its water cargo, extending downwardly from the Connector Shackle 45 the Lifting Cord 1133, passes through a Lifting Cord Passageway 1132, in the Camlock Bracket 1140, which is secured to the Rim Collar 80 by Camlock Bracket Fasteners 1142. The Lifting Cord 1133, then passes through a Spring Loaded Camlock 1144, which prevents the Mechanical Wishbones 1102 from collapsing unexpectedly, and exits the Camlock Bracket 1140, through a Lifting Cord Passageway 1132, again extending downwardly it passes through another Lifting Cord Passageway 1132, in the Free End Connector 1108, a Ball Stop 74 on the terminal end of the Lifting Cord 1133, provides an end stop and a Knot 76, secures it.

When tension is applied to the Lifting Cord 1133, it cooperates with the Free End Of Mechanical Wishbone 1103, and the Free End Connector 1108, which cooperates with the Mechanical Swing Arms 1104, to push against the Fixed End Of Mechanical Wishbones 1105, and the Fixed End Connectors 1106, to cooperate with the Side Wall 24, to thrust open the Wild Fire Fighting Water Bucket 20, free of any bucket weight being placed on the Rim Opening Device 1100, or it's Lifting Cord 1133.

FIG. 3

FIG. 3 shows a side elevation of a longitudinal Side Wall Panel 25, which has a Side Wall Panel Strip 48 dialectrically welded to it longitudinally. It has a Webbing Belt 42, with a loop on each end sewn to it, the combination being the First Flexible Tension Link Extension 41. The latter being connected to the First Flexible Tension Link 40 (suspension line), by means of a Connector Shackle 45, and a Connector Strap 43, FIG. 1, which is choke connected to the Upper Connector Loop 44, on the Webbing Belt 42. Both the Side Wall Panel Strip 48, and the webbing Belt are shown as dotted lines, centrally located longitudinally. The wider pair forming a Batten Pocket 50, into which a Batten 52, FIG. 1, is latterly inserted. The Lower Connector Loop 46, extending out the lower end of the Batten Pocket 50, to receive the Third Flexible Circumferential Structural Link 54, a Chain 55, which serves to partially support the weight of the Wild Fire Fighting Water Bucket 20.

The Wild Fire Fighting Water Bucket 20, has two circumferential means to adjust its capacity. Its Side Wall 24, has a plurality of Batten Pockets 50, dimensionally spaced apart and arranged longitudinally between the Rim 22, and the Bottom 26, of the Bucket Body 21, FIGS. 1, and 2. Battens 52, inserted therein provide stiffness to the Side Wall 24, to variably bulge outwardly when lifted out of the water, providing variable filling capacities. The upper ends of the battens terminating at the First Flexible Circumferential Structural Link 78, the Rim Collar 80, of the Wild Fire Fighting Water Bucket 20, the lower ends terminating adjacent the Third Flexible Circumferential Structural Link 54, a Chain 55, which passes through the Lower Connector Loops 46, FIGS. 1 and 3, on the terminal ends of a plurality of First Flexible Tension Link Extensions 41, i.e. the terminal end of the longitudinal Webbing Belt 42, sewn to the Side Wall Panel Strip 48, which has been dialectrically welded longitudinally to the Side Wall Panel 24. A, Mechanical Wishbone Abrasion Cover 1101, is shown FIG. 3, made of a tough abrasion resistant material it is dialectrically welded adjacent the Rim 22, on the inside of Side Wall Panel 24. It's purpose is to reduce abrasion caused by the opening and closing of the Rim Opening Device 1100.

FIG. 4

FIG. 4 is a diagrammatic side elevation, an inside view of the Side Wall 24, and that of a partially open Rim Opening Device 1100, affixed adjacent to the Rim 22, of the Wild Fire Fighting Water Bucket 20, which, has a centrally Open top 1114, its Mouth 23, being unrestricted by prior art type of structural members such as outdated hubs and spokes which restrict access into the interior of the Bucket Body 21. The latter having a Side Wall 24, made from a plurality of Side Wall Panels 25, dialectrically welded together. The elevation shows Pliable Side Wall Folds 94, of a partially open Bucket Body 21. The Rim Opening Device 1100, has a plurality of Mechanical Wishbones 1102, spread apart and dimensioned circumferentially around inside the Rim 22, of the Bucket body 21. Each Wishbone 1102, having both fixed and free ends, the Fixed End of Mechanical Wishbones 1105, being affixed adjacent the Rim 22, by means of a Fixed End Connector 1106, (a bracket) which secures it to the Rim Collar 80, by means of a Fixed End Rotatable Fastener 1112, which also rotatably connect the upper ends of the Mechanical Swing Arms 1104, their lower ends being rotatably connected to the Free End Connectors 1108, (a bracket) by means of the Free End Rotatable Fastener 1110, Both the Fixed End Connector 1106, and the Free End Connector 1108, receive the Mechanical Swing Arms 1104, in angled tracts, Connector Swing Arm Tracts 1157, refer to FIG. 8, *a, b,c*, which shows the Angle Of Inclination 1134. This angled, Connector Swing Arm Tract, serve the key purpose of thrusting the Rim Opening Device 1100, to open concentrically when tension is supplied to the Lifting Cord 1133.

FIG. 4 shows Mechanical Wishbone Abrasion Cover 1101, which protects the interior of the Side Wall 24, when the Free Ends of Mechanical Wishbones 1103, are thrust upwardly and outwardly to open the Bucket Body 22, concentrically. The, Side Wall Panel Strip 48, and First Flexible Tension Links Extension 41, and Webbing Belt 42, are shown as dotted lines arranged longitudinally beneath the Mechanical Wishbone Abrasion Cover 1101, which has been dialectrically welded to the Side Wall Panel 25, adjacent to the Rim 22.

The First Flexible Circumferential Structural Link 78, a Rim Collar 80, made of strong pliable vinyl material is doubled over a Rim Collar Rope 81, and a Webbing 90, all of which are structurally sewn by Stitching 92, to the upper end of the Bucket Body 21, at its terminal end to define the Rim 22, of the Wild Fire Fighting Water Bucket 20.

Each Mechanical Wishbone Arm 1104, which functions as a turnbuckle, has a Left Hand Adjuster 1111, having left hand threads, and a Right Hand Adjuster 1113, having right hand threads. The Mechanical Wishbone Arm 1104, thereby being longitudinally adjustable to size and having the means to tension the First Flexible Circumferential Structural Link 78, stiffening, the Rim Collar 80, which helps cutting the Rim 22, underwater facilitating rapid sinking of the Wild Fire Fighting Water Bucket 20. The rims of prior art buckets equipped with hubs and spokes tend to be looser not stretched tight, which tend to push the rim material up when contacting the water, temporarily forming a shallow hull which supports flotation rather than immersion. Prior art tipping weight attached to prior art side walls tend to distend the side wall also in the form of a shallow hull which also propagates flotation.

FIG. 5

Figure 5:
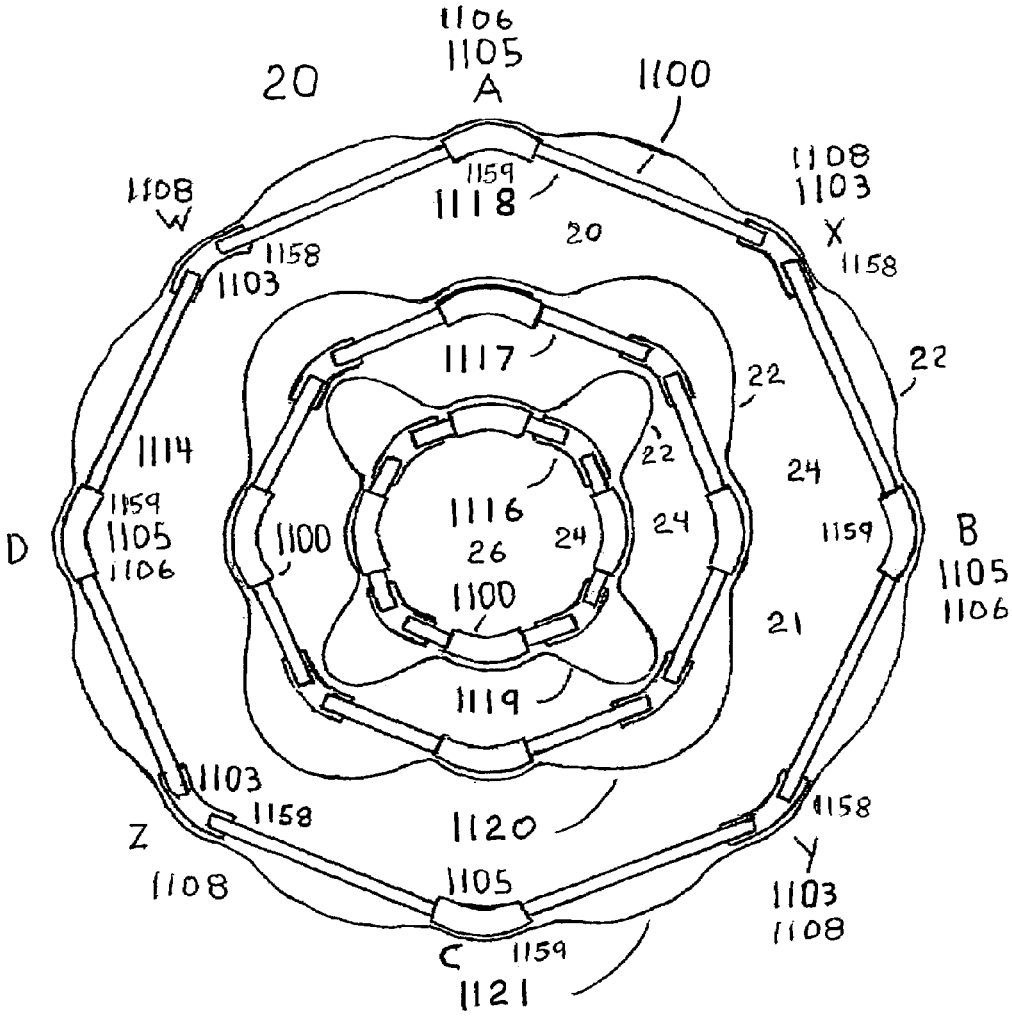

FIG. 5, is a plan view looking straight down into the wild fire fighting water bucket 20. It's purpose is to diagram the outward, concentric development of the Rim Opening Device 1100, and the profile of the side wall as the bucket opens or closes. Most other details have been eliminated for clarity purposes. The, Rim Opening Device Fully Collapsed 1116, is shown centrally therein and transitions to Rim Opening Device Partially Open 1117, and to Rim Opening Device Fully Open 1118. Similarly, the Fully Collapsed wild fire fighting water bucket shell profile 1119, transitions to, partially opened wild fire fighting water bucket shell profile 1120, and transitions to, fully opened wild fire fighting water bucket shell profile 1121. W, X. Y and Z indicating the free end of mechanical wishbone connector points 1158, and similarly A, B, C and D indicating the fixed end of mechanical wishbone connector points 1159. Fixed end connectors 1106, indicating the fixed end of mechanical wishbone 1105, and free end connectors 1108 indicating the free end of mechanical wishbone 1103.

FIG. 6

FIG. 6 is a diagrammatic side elevation of the Free end of Tubular Extension 32, Sealing Lip 60, the Front Sealing Lip 62, and the Opposite Sealing Lip 64, the sealing lips being made from Resilient Sealing Lip Material 61. The, Tubular Extension 30, made of strong pliable material is folded over, i.e. the Tubular Extension Fold Over 106. The, Distal End Of Tubular Extension 104, defines an Opening 28, which serves as a Discharge Port 35, and having the Terminal Edge Of Tubular Extension Fold Over 108, being Stitched 92, to the side wall of the Tubular Extension 30.

The, Sealing Lip 60, is Stitched 92, circumferentially there around the Opening 28, adjacent the Distal End of the Tubular Extension 104, which create the Front Sealing Lip 62, and the Opposite Sealing Lip 64. A plurality of aligned Grommets 68, are installed in the Tubular Extension Fold Over 106, with aligned Openings 66, pierced in the Resilient Sealing Lip Material 61, the latter is folded over to create a Teardrop Shaped Sealing Bulb 1124 (more than one fold over may be required. FIG. 6 shows a single fold over.) The Resilient Sealing Lip Material 61, being protected by an Abrasion Cover 1125. The Third Flexible Tension Link 70, i.e. purse lines alternately enter the Tubular Extension 30, from opposite sides, a Ball Stop 74, provides an end stop for travel, and a knot 76, secures it to the terminal end thereon.

Tension on the Third Flexible Tension Link 70, from the Second Flexible Tension Link 72 (not shown), draw the sealing lips into sealing engagement. The Teardrop Shaped Sealing Bulb 1124, has greater compressibility than other prior art flat sealing lips while the thinner end serves to restrict the kinking of the Tubular Extension 30

Figures 7A, 7B:
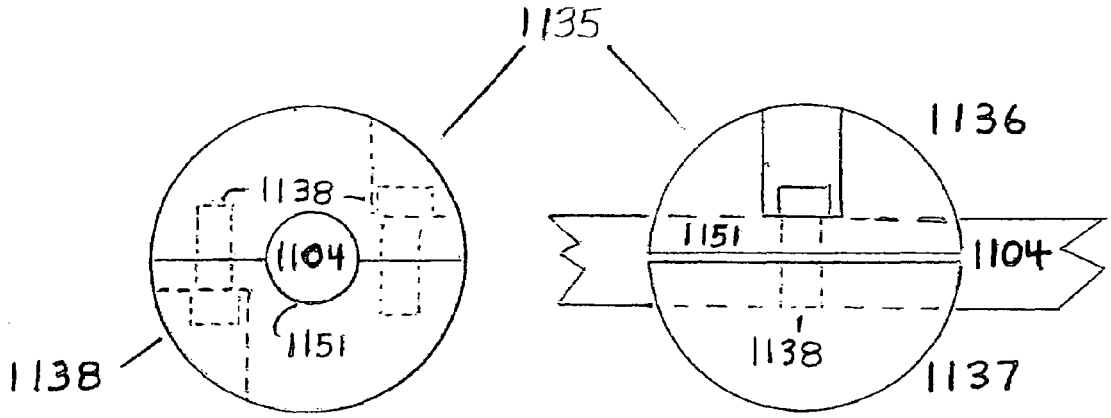

FIGS. 7*a* and 7*b*

FIG. 7*a* is a simplified end on elevation, while 7*b* is simplified side elevation, both representing round shaped Trimming Weights 1135, which consists of a Trimming Weight Upper Half 1136, and a Trimming Weight Lower Half 1137, which are held together by Trimming Weight Fasteners 1138, which locks the two halfs on to the Mechanical Swing Arm 1104, which have been slideably received in the Round Mechanical Swing Arm Tract 1151. The, Trimming Weights 1135, are optionally movable to aerodynamically adjust in flight characteristics, and adjust the tipping action of the Wild Fire Fighting water Bucket 20, to suit operational conditions or operator preferences.

FIGS. 8*a*, 8*b*, 8*c*

FIGS. 8*a*, and *c*, are simplified plan views of a Free End Connector 1108, having Connector Swing Arm Tracts 1157, which aligns the Mechanical Swing Arms 1104, on the Free End of Mechanical Wishbones 1103, by means of Free End Rotatable Fasteners 1110, which pass through an aligned Passageway 1122, through both sides of the Free End Connector 1108, and through an aligned Passageway 1122, in the Mechanical Swing Arm Adjuster 1111, (left hand thread) which is connected to the Mechanical Swing Arm 1104. A, Lock Collar 1175, FIGS. 4 and 8 *d*, serves as a locking nut, securing same. FIG. 8*b* is a simplified side elevation of a Free End Connector 1108.

The, Lifting Cord 1133, FIG. 4, passes through Lifting Cord Passageway 1132, and has a Ball Stop 74, to restrict lifting cord travel and a Knot 76, at its terminal end to secure it. The, Mechanical Swing Arm 1104, is free to rotate on the Free End Rotatable Fastener 1110, within the Mechanical Swing Arm Tract 1157, until it contacts the Free End Overcenter Stop 1109, a saddle, to hold the Mechanical Swing Arm 1104, level when the Rim Opening Device 1100, is full deployed.

Fixed End Connectors 1106, have a similar device, the Fixed End Overcenter Stop 1107, refer to FIG. 4. The Fixed End Connectors 1106, are installed upside down as to the Free End Connectors 1108, and rotated 180 degrees.

FIG. 8*b*, is a simplified side elevation of a Free End Connector 1108, with the Mechanical Swing Arm Tract 1157, which guides the Mechanical Wishbones 1102, FIG. 4, outwardly circumferential concentric development in cooperation with the pliable Side Wall 24 to fully open the Wild Fire Fighting Water Bucket 20.

FIG. 8 *d*

FIG. 8*d*, is a simplified side elevation of a Mechanical Swing Arm 1104, having a Mechanical Swing Arm Adjuster 1111, (left hand thread) on one end and a Mechanical Swing Arm Adjuster 1113 (right hand thread), on the other end, both of which have Lock Collars 1175 The adjustable Mechanical Swing Arm 1104, is utilized to tension the First Flexible Circumferential Structural Link 78, the Rim Collar 80, under compression which stiffens the Rim 22, of the Wild Fire Fighting Water Bucket 20, which facilitates the Rim 22, submersion.

FIG. 9

Figure 9:
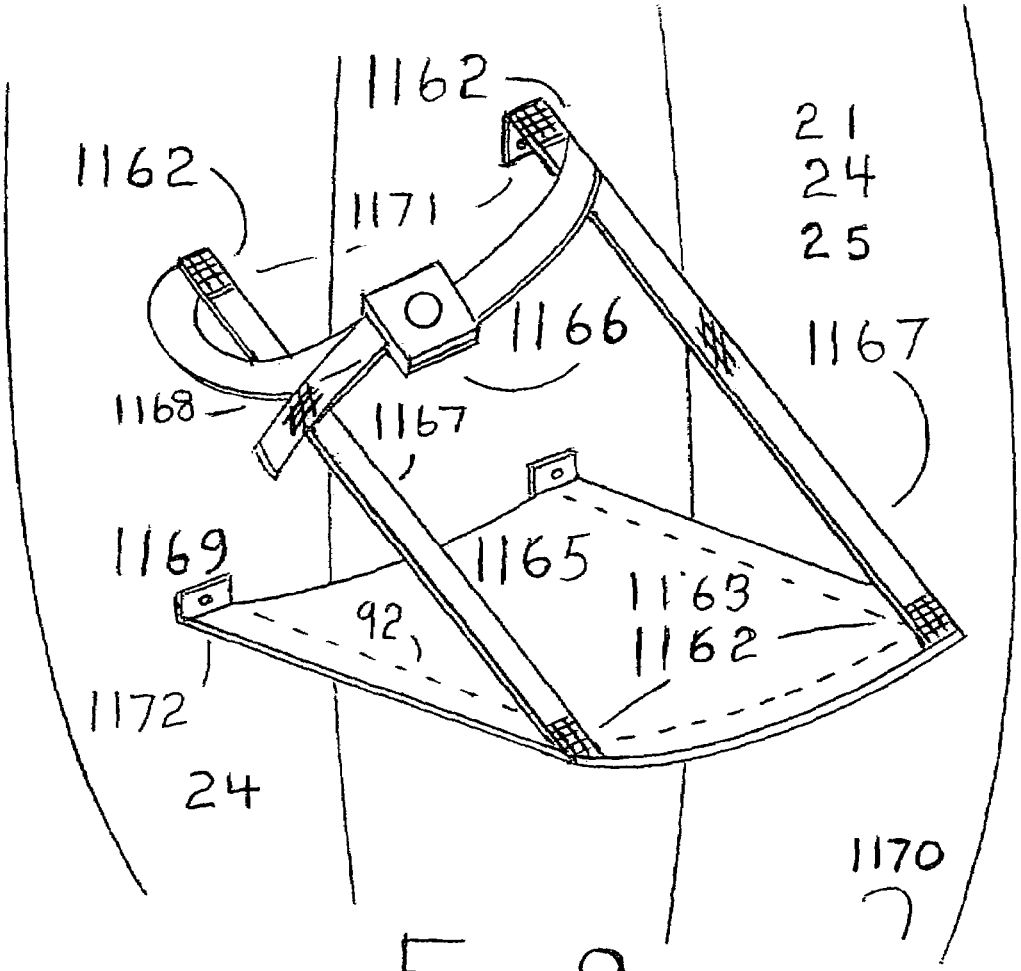

FIG. 9, is a diagrammatic side elevation of a deployed emergency Extractor Jump Seat 1165, having its pliable Seat Bottom 1163, made of pliable material, and having a Seat Belt Harness 1166, comprising a pair of Webbing Belts 1167, attached to the inside of a Side Wall Panel 25, of Side Wall 24, of Bucket Body 21, of a Wild Fire Fighting Water Bucket 20, by means of the Upper Connector 1171, and the Lower Connector 1172, the latter serving as a Seat Hinge 1169, and having its pliable Seat Bottom 1163, Stitched 92, to the Webbing Belt 1167, i.e. the dotted lines, and having a Seat Belt And Buckle 1168, connected to the upper end of the Webbing Belt 1167, by Upper Connector 1171. When not in use the Extractor Jump Seat 1165, is folded into the Side Wall 24, and releasably held in place by Velcro 1162, connectors. The use of such an assembly is meant for emergencies only. The Centrally Open Top 1114, of the Wild Fire Fighting Water Bucket 20, makes the use of this assembly possible. Prior art flexible, collapsible water buckets with cumbersome hubs and spokes blocking access into a bucket have until now denied the use of such an assembly.

Figure 10:
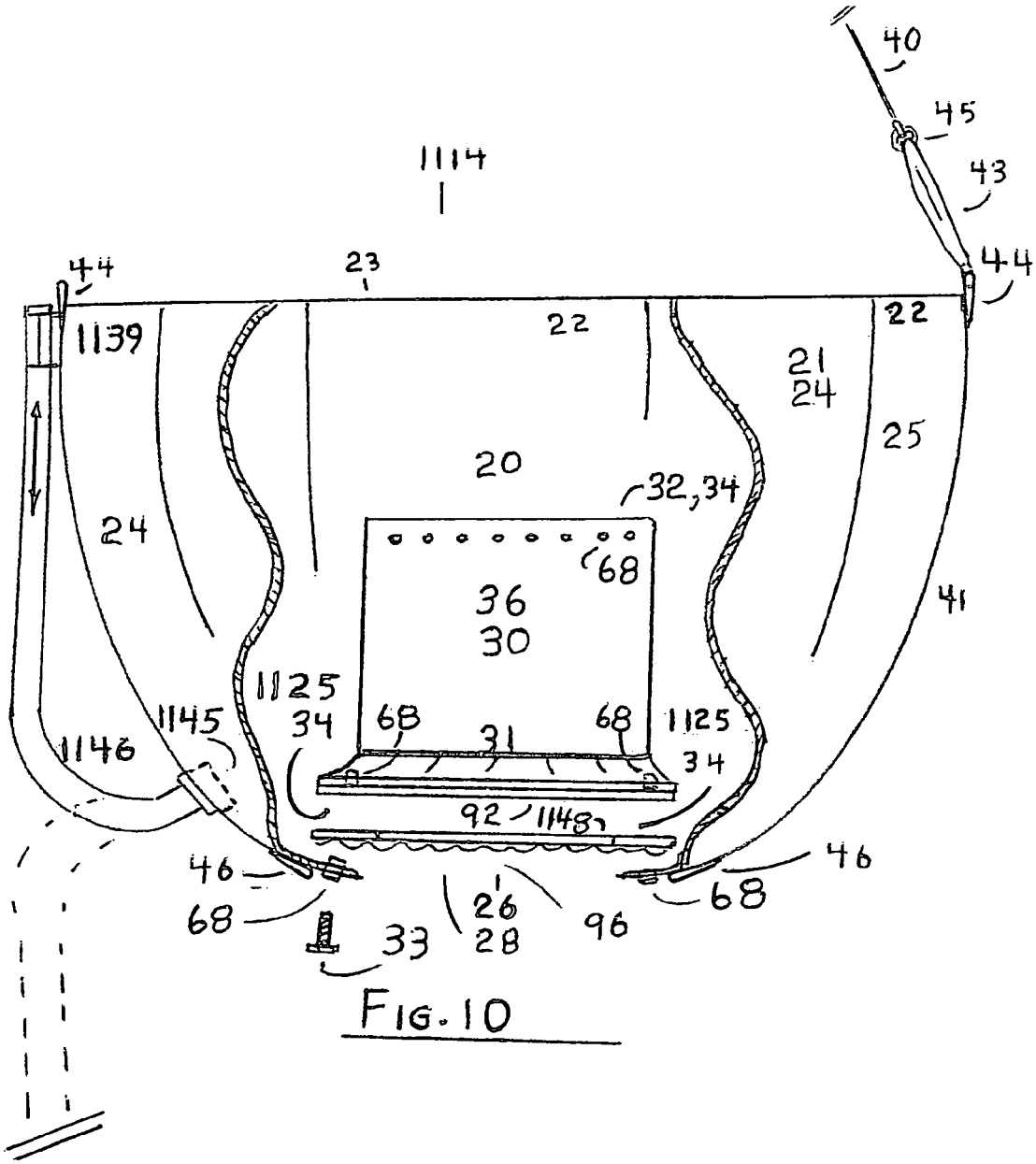
Figure 11:
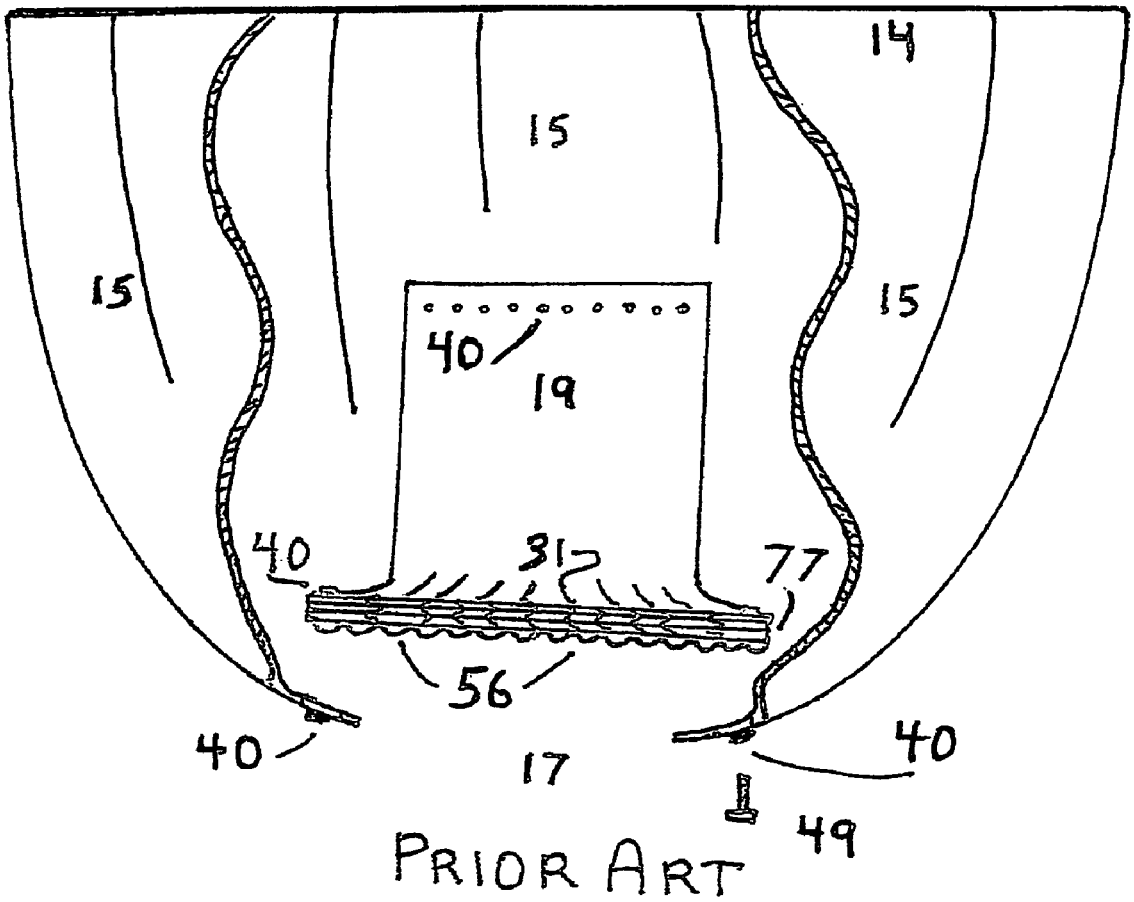

FIGS. 10 and 11

FIG. 10, is a fragmented side elevation of the Wild Fire Fighting Water Bucket 20, suspended from a helicopter (not shown) by a plurality of First Flexible Tension Links 40, (one shown), by means of a Connector Shackle 45, and a Connector Strap 43, which is choke connected to the Upper Connector Loop 44, at the upper extremity of the Side Wall Panel 25, refer to FIG. 3. The, Upper Connector Loop 44, sewn in to the First Flexible Tension Link Extension 41, providing the connecting means, and terminating at the Lower Connector Loop 46. The fragmented side elevation shows a Bucket Body 21, having a Side Wall 24, made from a plurality of Side Wall Panels 25, and having a Rim 22, which defines the Mouth 23 of a Centrally Open Top 1114. The Tubular Extension 30, which functions as a Dump Valve 36, is shown in exploded view, exposing both the Tubular Extension Sealing Collar 34, and the Lower Sealing Collar 1148, both of which are protected by a Abrasion Cover 1125. The Tubular Extension 30, made of a tough pliable material, and having Grommets 68, placed and spread apart on the Free End Of Tubular Extension 32, to receive the Third Flexible Tension Link 70, (not shown), refer to FIGS. 1, 2 and 6 and having Tubular Extension Mounting Flange 31, and Tubular Extension Fasteners 33, to secure it to the Bucket Body 21. A, Tubular Extension Sealing Collar 34, FIG. 1, is Stitched 92, to the Tubular Extension Mounting Flange 31, while a separate sealing collar, the Lower Sealing Collar 1148, is independently attached there around the Opening 28, in the Bottom 26, by means of Butyl Sealing Compound 96. Tubular Extension Fasteners 33, pass through Grommets 68, placed at the terminal end of the Side Wall 24, pass through the Lower Sealing Collar 1148, and pass through the Tubular Extension Sealing Collar 34, and through the resilient sealing material of the Tubular Extension Sealing Collar 34, which has been stitched to the Tubular Extension Flange 31. It then passes through a plurality of Grommets 68, placed circumferentially around the Tubular Extension Flange 31. The, Tubular Extension Fasteners 33, bringing the Tubular Extension 30, into sealing engagement with the Bucket Body 21. For servicing purposes, the Tubular Extension 30, can now be cleanly removed from the Bucket Body 21, without disturbing the troublesome Butyl Sealing Compound 96, which is a significant problem when servicing prior art tubular extensions especially during field operations.

The Wild Fire Fighting Water Bucket 20, has a third way to variably adjust the volume of water contained therein. An open topped Flexible Discharge Hose 1146, is connected to a bulkhead Fitting 1145, attached to the lower end of the Side Wall 24, of the Bucket Body 21, and its upper end is variably connected vertically to the Bucket Body 21, by the Vertically Adjustable Hose Bracket 1139. By vertically lowering the Flexible Discharge Hose 1146, within the Adjustable Hose Bracket 1139, water runs out the open top of the Flexible Discharge Hose 1146, thereby reducing the weight of the water cargo to match the strength of the helicopter. Operationally, this works well on the smaller water buckets where only a small amount of water needs to be drained off. When turned downwardly, the Flexible Discharge Hose 1146, (dotted lines) can be utilized by ground crews working in conjunction with the helicopter.

FIGS. 10 and 11

FIG. 11 is a fragmented side elevation of a prior art Tubular Extension 30, installation in a Bucket Body 21, which has only one sealing collar, the Tubular Extension Sealing Collar 34, which is a single piece of resilient neoprene folded over and sewn to the bottom of the Tubular Extension Mounting Flange 31. Butyl Sealing Compound 96, then binds the Tubular Extension 30, to the Bucket Body 21, and Tubular Extension Fasteners 33, secure the sealing engagement. All other reference numbers and description identical to FIG. 10.

By way of further explanation a) The Wild Fire Fighting Water Bucket 20, has four structural, vertically arranged, tension links. FIG. 1, 3, 4.
   i) #40 First Flexible Tension Link
   ii) #41 First Flexible tension Link Extension
   iii) #72 Second Flexible Tension Link
   iv) #70 Third Flexible Tension Link b) The, Wild Fire Fighting Water Bucket 20, has three circumferentially arranged structural links. FIG. 1, 2.
   i) #78 First Flexible Circumferential Structural Link 78,
   ii) #82 Second Flexible Circumferential Structural Link 82,
   iii) #54 Third Flexible Circumferential Structural Link, 54.

a, i, #40 First flexible tension links 40, are suspension lines connected to and supported by the control Head Connector 38, extending downwardly therefrom to be connected to the First Flexible Tension Link Extension 41, by Connector Shackle 45.

a, ii, #41 First Flexible Tension Link Extension 41, extend downwardly from the First Flexible Tension Link 40, and comprise Connector Shackle 45, and Connector Straps 43, the latter which are choke connected to Upper Connector Loops 44, which are stitched into a Webbing Belt 42, which is stitched to the Side Wall Panel Strip 48, which is then dialectrically or thermally welded to the Side Wall Panel 25, the Webbing Belt exiting its distal end, and formed into the Lower Connector Loops 46, which locates the Third Flexible Circumferential Structural Link 54, a Chain 55 circumferentially arranged to support the Bottom 26, of the Wild Fire Fighting Water Bucket 20. It is threaded through the Lower Connector Loops 46, and adjustably tensioned by another Connector Shackle 45, (not shown) FIGS. 1, 3.

a, iii, #72 The Second Flexible Tension Link 72, functions as a trip line, utilized to selectively load or discharge water cargo. It is adjustably connected to the Control Head Connector 38, by means of the Second Flexible Tension Link Adjuster Chain 71, the Control Head Connector 38, releasably supports the Second Flexible Tension Link 72, which extends downwardly therefrom, and having a Connector Ring 73, located at its distal end to adjustably connect the Third Flexible Tension Links 70, which are purse lines utilized to seal the Tubular Extension 30, when the Tubular Extension 30, is in the upright position under tension within the Wild Fire Fighting Water Bucket 20. When tension is released the Tubular Extension rapidly plunges downwardly, becoming a Dump Valve 36, discharging the water cargo out of the Discharge Port 35, a re-sealable opening on the Free End Of The Tubular Extension 32.

a. iv, #70 When tension is applied to the Third Flexible Tension Link 70, which function as purse lines to gather the two sides of Sealing Lip 60, on the Free End of The Tubular Extension 32, "ie" the Front Sealing Lip 62, and the Opposite Sealing Lip 64, into a water tight sealing engagement. The Third Flexible Tension Links 70, are made from soft, flexible, but strong woven nylon cordage. A, Ball Stop 74, and a Knot 76, tied on the distal end thereof provides for an end stop. They alternatively pass through aligned grommets located on opposite sides of the Sealing Lip 60, extending upwardly to be adjustably tied to the Connector Ring 73, which is releasably supported by the Second Flexible Tension Link 72.

b, i, #78 The, First Flexible Circumferential Structural Link 78, defines the shape of a Rim Collar 80, made from a flexible vinyl, material which is folded over a Rim Collar Rope 81, and structurally trimmed with Webbing 90, all of which are securely sewn together and Stitched 92, to the Rim 22, of the Wild Fire Fighting Water Bucket 20, FIGS. 1, 3. Compression generated by the adjustable Rim Opening Device 1100, outwardly developing concentric expansion, serves to tension the Rim 22, under compression, stiffening the distal edge of the Mouth 23, i.e. the Rim 22, for quicker submersion when filling the Wild Fire Fighting Water Bucket 20. Prior art bucket flexible rims have a tendency to promote the bucket to float on the surface before slowly sinking. The hard tensioned edge of the Wild Fire Fighting Water Bucket 20, tends to dive underwater submerging same very quickly, a definite advantage in time sensitive fire fighting operations.

b, ii, #82 The, Second Flexible Circumferential Structural Link 82, is an adjustable webbing belt which runs around the midpoint of the Wild Fire Fighting Water Bucket 20. Its purpose is to selectively adjust the volume of water contained therein to match operational conditions and the strength of the helicopter. It comprises a Cinch Strap 84, made of nylon webbing which runs through Cinch Strap Loops 86, secured to and dimensioned around the Sidewall 24. An adjustable Buckle 88, being utilized to lock the Cinch Strap 84, in the desired position. FIGS. 1, 2, & 3.

b, iii, #54 The, Third Flexible Circumferential Structural Link 54, can be a rope, cable, or chain, the Chain 55, being the preferred method due to its adjustability. The Third Flexible Circumferential Structural Link 54, i.e. the Chain 55, is passed through the Lower Connector Loops 46, which are dimensioned around the distal end of the Sidewall 24. It is adjustably connected and tensioned to support the weight of the Wild Fire Fighting Water Bucket 20. FIGS. 1 & 3.

FIG. 5, is a three stage sequential diagrammatic plan view showing the concentric transitional development of the Rim Opening Device 1100, and outgrowth of the Rim 22, contour.

Each wishbone arm 1104, is equipped with a turnbuckle type, adjusting method having both left and right hand threaded ends to variably adjust the length of the wishbone arms 1104. Left Hand Adjusters 1111, have left hand threads and Right Hand adjusters 1113, have right hand threads. Lengthening the arm stiffens the First Flexible Circumferential Structural Link, 78; ie the Rim Collar 80, by putting it under circumferential compression, the stiffened Rim 22, cuts into the water, facilitating rapid immersion.

FIG. 5, is a simplified plan view of the Wild Fire Fighting Water Bucket 20, looking downwardly there into through the Centrally Open top 1114. It shows the transitional development of the Rim Opening Device 1100, the Bucket Body 21, the Side Wall 24, and the contour of the Rim 22, during opening and closing of the Wild Fire Fighting Water Bucket 20. As it opens the Rim Opening Device 1100, transitions concentrically from the Rim Opening Device Fully Collapsed 1116, mode, to the Rim Opening Device, Partially Open 1117, mode, to the Rim Opening Device, Fully Open 1118, mode. Similarly, the Rim 22 and Side Wall 24, develop outgrowth contours in co-operation with expansionary outwardly concentric development of the Rim Opening Device 1100, completing full form development.

All Mechanical Wishbones 1102, have their Fixed End Of Mechanical Wishbones 1103, affixed adjacent the Rim 22, of the Bucket Body 21, i.e., the Fixed End of Mechanical Wishbone Connector Points A, B, C and D, 1159. The, Fixed End Rotatable Fasteners 1112, FIG. 4, secure the Fixed End Connectors 1106, thereto the Rim 22, and provide the means to rotatably connect the Mechanical Swing Arm 1104, downwardly therefrom.

The, Free End Connector 1108, rotatably connects the other end of the Mechanical Swing Arm 1104, by means of a Free End Rotatable Fastener 1110, this end, the Free End Of Mechanical Wishbone 1104, has Free End Of Mechanical Wishbone Connector Points W, X, Y, and Z, 1158. The, Mechanical Wishbones 1102, cooperate with the pliable Side Wall 24, of the Bucket Body 21, to open or close the Wild Fire Fighting Water Bucket 20.

Both the Fixed End Connectors 1106 and the Free End Connectors 1108, have Connector Swing Arm Tracts 1157, which are guide tracts which functionally control the concentric outwardly development of the Rim Opening Device 1100, opening the Bucket Body 21.

Both the Fixed End Connectors 1106, and Free End Connectors 1108, embody an Angle Of Inclination 1134, FIGS. 8A and 8C, in their design, and incorporate identical Angles Of Inclination 1134, on the Fixed End Connectors 1106, and Free End Connectors 1108. When, the Bucket Body 21, grows outwardly in a horizontally developing plane it is preferable that the rising Free End Connectors 1108, guide their own development and that of the Mechanical Swing Arms 1104, in a concentric plane. However, other variations could be made to function. The Free End Connector 1108, is installed upside down and rotated 180 embody an Angle Of Inclination 1134, FIG. 8A degrees as to the Fixed End Connector 1106, FIG. 4. The Mechanical Wishbones 1102, Angle of Inclination FIGS. 8A and 8C,—1134, converts vertical lifting moments, i.e. tension on lifting cord 1133—to vertically and horizontally thrust open the Rim Opening Device 1100, in co-operation with the Side Wall 24, to open the Wild Fire Fighting Bucket 20.

A, Rim Opening Device 1100, having four interconnected Mechanical Wishbones 1102, requires four Fixed End Connectors 1106, and four Free End connectors 1108, with matching Angles of Inclination 1134, to produce an eight sided polygon figure, i.e. FIGS. 2, and 5, connector points A, X, B, Y, C. Z. D, W.

Connector points A, B, C, D, are Fixed End Of Mechanical Wishbone Connector Points, 1159, having Fixed End Connectors 1106, while Free End Of Mechanical Wishbone Connector Points W, X, Y, Z, 1158, have Free End Connectors 1108. FIGS. 2 and 5.

In the same context a bucket having a Rim Opening Device 1100, having five Mechanical Wishbones 1102, would produce a ten-sided polygon while one having three Mechanical Wishbones 1102, would produce a six sided polygon figure and so on.

Aerial fire fighting water buckets are sized to meet the lifting capability of individual helicopters, approximately fifteen different sizes are common to the industry. Accordingly, the capacities and dimensions of the buckets are varied to comply with the require specifications. Various sized buckets, each equipped with a wishbone type Rim Opening Device 1100, as described herein, have an interlocking dimensional and structural relationship between the Mechanical Wishbone Connectors, Angle Of Inclination 1134, and both the diameter of a drawn circle radially connecting the distal ends of each segment of a horizontally arranged polygon in the form of a Rim Opening Device, and the number of segments contained therein. A, Wild Fire Fighting Water Bucket, having four Mechanical Wishbones 1102, would have four segments and so on.

For Example Only: Take a Rim Opening Device 1100, equipped Wild Fire Fighting Water Bucket 20, and benchmark its diameter—as described above—and effect dimensional changes to firstly its diameter and, secondly the number of segments (wishbones) contained therein.

Example (a) If we change both the diameter and the number of segments we change both the Angle Of Inclination 1134, and the dimensions of the segments.

Example (b) If we only change diameter, the Angle Of Inclination 1134, remains the same, but the segments are dimensionally altered.

Example (c) If we only change the number of segments then we also change the Angle Of Inclination 1134, of the segments.

The above examples represent an interlocking relationship which can be expressed numerically.

All prior art buckets utilized attached weights of one description or another to achieve quick tipping action and to submerge the bucket quickly in an open body of water for filing. The Rim Opening Device 1100, solves this problem in an unique way. The Rim Opening Device 1100, provides sufficient tipping action by utilizing in its construction, materials which have significant differences in their specific gravities when compared to each other, i.e. aluminum versus steel, light versus heavy. Mechanical Swing Arms 1104, and, Fixed End Connectors 1106, and Free End Connectors 1108, made from a heavy metal are arranged on one side of the Wild Fire Fighting Water Bucket 20, while lighter materials are similarly utilized for the opposite side. The weight differential being sufficient to achieve the desired results. The geometry of the tipping action benefits by the placement of the tipping weight differential being placed strategically at the rim, thereby slightly reducing the amount of weight required to create a desired tipping action, and provides torquing action, which facilitates a quicker tipping action.

The, Rim Opening Device 1100, differentiates itself from prior art flexible bucket ballasting means by contiguously enjoining the ballast circumferentially and horizontally in union with the buckets upper terminus, thereby densely concentrating and centralizing the tipping action by optimizing ballast positioning contiguously at the Wild Fire Fighting Water Buckets 20, upper distal extremity not nearly adjacent or below it which is the case of all prior art flexible buckets.

The circumferential and horizontal placement of centralized ballast in contiguous union with the Rim 22, optimizes the gravitational moment while maximizing its Metacentric Height to achieve superior tipping, filling and in-flight characteristics. Vertically arranged ballast blocks or bags placed merely adjacent or well below the Rim 22, as is the case with all prior art flexible buckets, have a much lower gravitational moment and subsequent lower Metacentric Height which translates into slower tipping, filling and poorer in-flight characteristics. These differences can be mathematically calculated using common, proven mathematical formulas for aircraft and ship stability calculations.

A Rim Opening Device 1100, utilizing materials in its construction which have significantly different specific gravities as described above provide additional benefits. It is no longer necessary to punch several holes through the side wall of the bucket to secure bulky ballast bags or blocks, all of which can cause leakage or damage to the shell of the bucket where bulky external weight blocks or bags encounter hang ups or when harness suspension lines become entangled with protruding weights. Weight blocks externally attached to the bucket side create disturbance of air flows around the bucket when in flight causing tendencies for bucket rotation. The elimination of externally affixed bulky weights and their fastener straps from the outside shell of the bucket serves to provide a cleaner, more aesthetic, aerodynamic form, reducing bucket rotation accordingly. Additionally, Rim Opening Device 1100, equipped Wild Fire Fighting Water Bucket 20, as described herein, eliminate the need for internal bracings such as hubs and spokes which can also cause suspension & harness line entanglement.

Trimming Weights 1135, FIG. 7, are slideably adjustable on a Round Mechanical Swing Arm Tract 1151, provides the means to locate the Trimming Weights 1135, on the Mechanical Swing Arms 1104, they have Trimming Weight Upper Half 1136, and a Trimming Weight Lower Half 1137, and are secured by Trimming Weight Fasteners 1138. They have two purposes (a) to provide aerodynamic trimming of the Wild Fire Fighting Water Bucket 20, (b) to provide an incremental amount of weight to adjust the tipping action.

The Rim Opening Device 1100, is installed inside the Rim 22, out of the direct airflow which passes overhead. Current art buckets have their hubs and the tops of their inclined spokes extending above the rim deflecting and re-directing fast moving air into the bucket, agitating the water and causing water loss out.

Another objective of this invention was to improve serviceability, especially associated with servicing the Tubular Extensions 30, repair or replacement.

The design and installation of prior art tubular extensions make servicing for repair or replacements most difficult, especially if it is to be undertaken during field operations. During manufacture the prior art resilient neoprene collars, i.e. the Tubular Extension Sealing Collar 34, FIG. 11, is folded over and sewn to the underside of the Tubular Extension Mounting Flange 31, a Butyl Sealing Compound 96, applied and it is then bolted to the Bucket Body 21. Removing the installed Tubular Extension 30, is made most difficult by the Butyl Sealing Compound 96, usually large chunks of neoprene are ripped out during the removal process. It is then necessary to remove the sticky compound and damaged neoprene before replacement.

The solution to this problem is to provide a secondary collar, the Tubular Extension Sealing Collar 34, FIG. 10, being sewn to the Tubular Extension Mounting Flange 31, while the Lower Sealing Collar 1148, is firmly attached to the Bucket Body 21, by the Butyl Sealing Compound 96. Abrasion Cover 1125, on both abutting collars protect the resilient neoprene material. Tubular Extension Fasteners 33, secure the Tubular Extension 30, to the Bucket Body 21. When servicing is required the Tubular Extension Fasteners 33, are removed, leaving the Lower Sealing Collar 1148, in place, both the Tubular Extension Sealing Collar 34, and the Lower Sealing Collar 1148, are free to separate without the mess and damage associated with servicing prior and tubular extensions.

The, Wild Fire Fighting Water Bucket 20, is equipped with flip up-down emergency extractor Jump Seats 1165, hinged to the inside Side Wall 24, of the Wild Fire Fighting Bucket 20, held in place by Velcro Strips 1162. A Seat Belt Harness 1166, an adjustable Seat Belt And Buckle 1168, provide security. A flip up-down Discharge Port Cover 1170, (not shown for clarity purposes), hinged to the inside Side Wall 24, of the Bucket Body 21, is utilized to provide footing.

VARIATIONS AND ALTERNATIVES

The amount of weight required to provide adequate tipping action is directly related to the size and capacity of Wide Fire Fighting Water Bucket 20. The offsetting weight coming from the weight differential between lighter Rim Opening Device 1100, structural components being on one side, while heavier components being used on the opposing side. Whereas there is a significant difference in the specific gravity quotion of lighter materials, ie, for example, aluminum versus heavier materials, ie, steel. If it is necessary to gain additional weight differential for the larger Wide Fire Fighting Water Buckets 20, by varying the materials used in the wishbone arms construction, a heavier solid bar versus a hollow section, a square bar for a round, a rectangular bar for a square bar and an irregular shaped bar for a rectangular bar, etc.

Additional trimming weights as shown in FIG. 7 can be utilized. This invention describes a Rim Opening Device 1100, having a Lifting Cord 1133, guided through a Spring Loaded Camlock 1144, for the purpose of restraining the Rim Opening Device 1100, from collapsing when the Wide Fire Fighting Water Bucket 20, is empty, or during impact with the water when dipping into the water, or during hard landings. Clearly there are many ways to achieve this connection. The restrainer has only the weight of the Rim Opening Device 1100, to hold up, which in turn stops the bucket from collapsing. Any quick connector could be used for this purpose, ie, a light chain and toggle, a cleat, a clevis, a closable link or a snap pin located on the free-end connector to restrict movement from the fully open position.

While the specific embodiments and application of the Rim Opening Device 1100, has been disclosed herein, the invention encompasses alternatives of the art. Their description which follows utilizes the enclosed drawings for easy referral. As stated earlier in detailed descriptions, it is preferred that the Rim Opening Device 1100, be installed adjacent the Rim 22, and inside the Bucket Body 21, however other locations can be made to function.

Again, it is preferable that the Mechanical Wishbones 1102, be interconnected to form a closed plane polygon when the Rim Opening Device 1102, is fully deployed circumferentially around the Rim 22. The Mechanical Wishbones 1102, being connected to the Rim 22, of the Wide Fire Fighting Water Bucket 20, by Fixed End Connectors 1106, each of which has two tracts, i.e. Mechanical Swing Arm Tracts 1157, for receiving Mechanical Swing Arms 1104, ie. one from each adjoining Mechanical Wishbone 1102, thereby interconnecting all Mechanical Wishbones 1102, to form a horizontally arranged closed plane figure. However, an aerial Wide Fire Fighting Water Bucket 20, as described herein equipped with independent Wishbones 1102, ones which are not interconnected but are fixed dimensionally, spaced apart, around the bucket rim could be made to functionally open the bucket. The Fixed End Connectors 1106, would each only have one Mechanical Swing Arm Tract 1157, for securing its own Mechanical Swing Arm 1104. It would still open the Wide Fire Fighting Water Bucket 20. The tough pliable Side Wall 24, between the single Fixed End Connectors 1106, deforms, simulating an angle of inclination, when filled the bucket takes a somewhat symmetrical shape.

There are a number of disadvantages to this alternatives, but it could be made to function. Similarly, Rim Opening Device 1100, equipped aerial Wild Fire Fighting Water Bucket 20, not in the form of a closed plane polygon are poor alternatives, but once again they can be made to function with a Rim Opening Device 1100, or equivalent. Bucket rim, circumferential opening devices comprising rotatable swing arms, each having multiple rotatable, compounding, fixed end joints or connectors which when connected to the free end of a wishbone by a similar connector could be made to circumferentially and functionally open a wild fire fighting bucket. The physical function that opening applicably simulating or duplicating the angle of inclination utility which is a material element of this invention falls within the scope of this invention.

While the embodiment of a Wide Fire Fighting Water Bucket 20, has been disclosed herein as an eight-sided polygon in shape, any bucket shaped in the form of a multi-sided polygon having similar embodiments can be utilized to produce a similar function. Alternative shapes created by varying the number of sides comprising the polygon may be useful to adapt the Rim Opening Device for other applications.

Alternative uses may be made from the Rim Opening Device 1100, mechanism, adapted or re-configured to other useful needs and applications, ie. such as collapsible containers, pliable enclosures, temporary structures, closures, valves.

For example: If we reconfigure a Rim Opening Device 1100 and install it upside down in the bottom of a Wide Fire Fighting Water Bucket 20, it can be made to function as a multi dump valve which can be opened or closed at the operators discretion. With the Fixed End Connectors 1106, being attached to the Side Wall 24, adjacent to the distal end of the Side Wall 24, and having a pliable bottom, beneath the reconfigured Rim Opening Device 1100, equipped with a resilient sealing lip, when the Free End Connector 1108, are pulled up the Rim Opening Device 1100, transitions to a Multi Dump Valve opening the closure, sealing closure between the Multi Dump Valve, and the interior of the Side Wall 24, is accomplished by a pair of opposing resilient sealing lips, when tension is released, the weight of the water pushes, on the pliable bottom to effect sealing.

The embodiment of this invention for example can be reconfigured into portable, pliable, collapsible structures such as enclosures and collapsible containers. Further mechanical equivalents will be apparent in which elements of the Rim Opening Device 1100, are replaced by parts that perform substantially the same function in substantially the same way to achieve substantially the same results and such equivalents are within the scope of the present invention.

OPERATIONS

The bucket in its collapsed state can be transported by helicopter to a staging area for operations. Once unloaded from the helicopter it is necessary to prepare the bucket for its assigned duty. After removal from its' carrying bag the bucket needs to be assembled for duty.

Once the Control Head Connector 38, is attached to the Support Line 100, and the Electric Cord 98, is plugged into an electrical supply line from the helicopter (not shown), the Wild Fire Fighting Water Bucket 20, can be deployed, lifting tension from the helicopter will automatically open the Wild Fire Fighting Water Bucket 20, i.e. FIG. 5, becoming Rim Opening Device Fully Open 1118, and Fully Open Wild Fire Fighting Water Bucket Shell Profile 1121. Alternatively, it can be opened manually while still on the ground.

The Lifting Cords 1133, are manually pulled up, causing the Free End Of Mechanical Wishbones 1103, to co-operate with the Mechanical Swing Arms 1104, and with the Fixed End of Mechanical Wishbones 1105, and the flexible Side Wall 24, to thrust the Rim Opening Device Fully Open 1118, which now develops the Fully Open Wild Fire Fighting Water Bucket Shell Profile 1121. The, Free End Of Mechanical Wishbones 1103, rising to the Rim 22, the Centrally Open Top 1114, of the Bucket Body 21, forming a horizontal closed plane, and held open by Spring Loaded Camlocks 1144, and tension generated at the Rim 22, by the adjustable Mechanical Swing Arms 1104.

The Second Flexible Circumferential Structural Link 82.—can now be adjusted to meet the lifting capabilities of the helicopter. Markings on tags sewn to the Cinch Strap 84, guide the operator in the selection process. The Cinch Strap 84 being slideably received in Cinch Strap Loops 86, runs around the inside of the Side Wall 24, terminating with a lockable Buckle 88. The operator pulls the Cinch Strap 84, through the Buckle 88 to the desired capacity and locks the Buckle 88. The, Tubular Extension 30, is withdrawn into the Bucket Body 21, under the force of the recoil Spring Reel 56, which applies tension on the Second Flexible Tension Link 72, which in turn applies tension on the Third Flexible Tension Links 70, which holds the Tubular Extension 30, upright in the Bucket Body 21, a releasable Trip Mechanism 58, holds the Second Flexible Tension Link 70, from releasing the Tubular Extension 30. The, Control Head Connector 38, complete with First Flexible Tension Link 40, (suspension lines), connected to the helicopter which now flies the suspended bucket to an open body of water. The bucket is lowered on to the lake, its heavier side tipping the bucket over submerging the rim, the weight of the ballasted Mechanical Swing Arms 1104, and the weight of the Third Flexible Circumferential Structural Link 54, ie. the Chain 55, acting to quickly submerge the entire Wild Fire Fighting Water Bucket 20.

The helicopter now pulls the Wild Fire Fighting Water Bucket 20, up and out of the water, tension being applied to the Third Flexible Tension Link 70, and by the weight of the water, ie, hydrostatic pressure acting on the sides of the Tubular Extension 30, helps the sealing engagement. The releasable Trip Mechanism 58, in the Control Head Connector 38, holds the Second Flexible Tension Link 72, from releasing the Tubular Extension 30. The tension on the Third Flexible Tension Link 70, ie. the purse strings, brings the Sealing Lip 60, into sealing abutment, preventing water leakage from the Discharge Port 35, which is in its upright position below the water level in the Wild Fire Fighting Water Bucket 20.

Another method of adjusting the fill level in the bucket is to vary the pulling force of the helicopter as it lifts the bucket up out of the water. Stiff Battens 52, are dimensioned around the Side Wall 24, in Batten Pockets 50, arranged longitudinally and remain essentially straight when the bucket is pulled slowly out of the water to bulge outwardly thereafter. This slow pulling action results in a lower level of water in the Wide Fire Fighting Water Bucket 20, as compared to a strong rapid pull which tends to bulge the stiffening Battens 52, while still under water, resulting in a higher water level fill.

Additionally, another method of adjusting the fill level in a small bucket is available by means of the Flexible Discharge Hose 1146. Prior to flight, the operator positions the distal end of the Flexible Discharge Hose 1141, incrementally below the rim and the hose will overflow accordingly adjusting the fill level parallel to the top of the hose. Ground crews utilize this hose to fill water back pack, water reservoirs, etc. when slung under the helicopter.

The Wide Fire Fighting Water Bucket 20, now filled with water, is flown to the site of the fire for dumping. The pilot activates an Electric Solenoid 59, in the Control Head Connector 38, which releases the tension on the Tubular Extension 30, which allows it to plunge downwardly under the weight of the water, which evacuates the Wild Fire Fighting Water Bucket 20, now the force of the Spring Reel 56, pulls the Tubular Extension 30, back to the upright position within the Bucket Body 21, thereby allowing the Wide Fire Fighting Water Bucket 20, to be refilled.

The emergency extractor Jump Seat option should only be used for lifesaving, dire straits extraction when firefighting personnel are about to be overrun by a fire storm and when other safe extraction methods are not practical or available. The helicopter operator utilizing a non-rotating steel line of sufficient length would lower the Wide Fire Fighting Water Bucket 20, on to the extraction site, lay it over on to its side, slacking the lifting line to facilitate access passed the First Flexible Tension Links 40, (suspension lines) which can be parted therefrom.

The Centrally Open Top 1114, of the Wide Fire Fighting Water Bucket 20, provides easy access into the interior of same. The first to enter would flip a Discharge Port Cover 170, down then position him or herself facing outward and the rest of the crew would follow suit. The helicopter now lifts the bucket to the vertical position which allows the crew to arrange themselves into the extractor jump seats which they have deployed, securely strapping themselves into the Seat Belt Harnesses 166, provided. The helicopter now flies the evacuees out of harms way to a first aid or fire base station.

| New No. | Element Name |
|---|---|
| 20 | Wild Fire Fighting Water Bucket |
| 21 | Bucket Body |
| 22 | Rim |
| 23 | Mouth |
| 24 | Sidewall |
| 25 | Sidewall Panel |
| 26 | Bottom |
| 27 | Harness |
| 28 | Opening |
| 29 | |
| 30 | Tubular Extension |
| 31 | Tubular Extension Mounting Flange |
| 32 | Free End of Tubular Extension |
| 33 | Tubular Extension Fasteners |
| 34 | Tubular Extension Sealing Collar |
| 35 | Discharge Port |
| 36 | Dump Valve |
| 37 | Fixed End Of Tubular Extension |
| 38 | Control Head Connector |
| 39 | |
| 40 | First Flexible Tension Link |
| 41 | First Flexible Tension Link Extension |
| 42 | Webbing Belt |
| 43 | Connector Strap |
| 44 | Upper Connector Loop |
| 45 | Connector Shackle |
| 46 | Lower Connector Loop |
| 47 | |
| 48 | Sidewall Panel Strip |
| 49 | |
| 50 | Batten Pocket |
| 51 | |
| 52 | Batten |
| 53 | |

-continued

| New No. | Element Name |
|---|---|
| 54 | Third Flexible Circumferential Structural Link |
| 55 | Chain |
| 56 | Spring Reel |
| 57 | |
| 58 | Trip Mechanism |
| 59 | Electric Solenoid |
| 60 | Sealing Lip |
| 61 | Resilent Sealing Lip Material |
| 62 | Front Sealing Lip |
| 63 | |
| 64 | Opposite Sealing Lip |
| 65 | |
| 66 | Opening |
| 67 | |
| 68 | Grommet |
| 69 | |
| 70 | Third Flexible Tension Link |
| 71 | Second Flexible Tension Link Adjuster Chain |
| 72 | Second Flexible Tension Link |
| 73 | Connector Ring |
| 74 | Ball Stop |
| 75 | |
| 76 | Knot |
| 77 | |
| 78 | First Flexible Circumferential Structural Link |
| 79 | |
| 80 | Rim Collar (vinyl material) |
| 81 | Rim Collar Rope |
| 82 | Second Flexible Circumferential Structural Link |
| 83 | |
| 84 | Cinch Strap |
| 85 | |
| 86 | Cinch Strap Loops |
| 87 | |
| 88 | Buckle |
| 89 | |
| 90 | Webbing |
| 91 | |
| 92 | Stitching |
| 93 | |
| 94 | Pliable Sidewall Fold |
| 95 | |
| 96 | Butyl Sealing Compound |
| 97 | |
| 98 | Electric Cord (to helicopter) |
| 99 | |
| 100 | Support Line (to helicopter) |
| 101 | |
| 102 | |
| 103 | |
| 104 | Distal End Of The Tubular Extension |
| 105 | |
| 106 | Tubular Extension Fold Over |
| 107 | |
| 108 | Terminal Edge Of Tubular Extension Fold Over |
| 109 | |
| 110 | |
| 111 | |
| 112 | Tubular Extension Restrainer |
| NEW ART | |
| 1100 | Rim Opening Device |
| 1101 | Mechanical Wishbone Abrasion Cover |
| 1102 | Mechanical Wishbones |
| 1103 | Free End Of Mechanical Wishbone |
| 1104 | Mechanical Swing Arms |
| 1105 | Fixed End of Mechanical Wishbones |
| 1106 | Fixed End Connectors |
| 1107 | Fixed End Overcenter Stop |
| 1108 | Free End Connectors |
| 1109 | Free End Overcenter Stop |
| 1110 | Free End Rotatable Fastener |
| 1111 | Left Hand Adjuster |
| 1112 | Fixed End Rotatable Fastener |
| 1113 | Right Hand Adjuster |
| 1114 | Centrally Open Top |

-continued

| New No. | Element Name |
|---|---|
| 1115 | |
| 1116 | Rim Opening Device, Fully Collapsed |
| 1117 | Rim Opening Device, Partially Opened |
| 1118 | Rim Opening Device, Fully Opened |
| 1119 | Fully collapsed Wide Fire Fighting Water Bucket Shell Profile |
| 1120 | Partially opened Wide Fire Fighting Water Bucket Shell Profile |
| 1121 | Fully Opened Wide Fire Fighting Water Bucket Shell Profile |
| 1122 | Passageway |
| 1123 | |
| 1124 | Teardrop Shape Sealing Bulb |
| 1125 | Abrasion Cover |
| 1126 | |
| 1127 | |
| 1128 | |
| 1129 | |
| 1130 | |
| 1131 | |
| 1132 | Lifting Cord Passageway |
| 1133 | Lifting Cord |
| 1134 | Angle Of Inclnation |
| 1135 | Trimming Weight |
| 1136 | Trimming Weight Upper Half |
| 1137 | Trimming Weight Lower Half |
| 1138 | Trimming Weight Fastener |
| 1139 | Vertically Adjustable Hose Bracket |
| 1140 | Camlock Bracket |
| 1141 | |
| 1142 | Camlock Bracket Fasteners |
| 1143 | |
| 1144 | Spring Loaded Camlocks |
| 1145 | Bulkhead Fitting |
| 1146 | Flexible Discharge Hose |
| 1147 | |
| 1148 | Lower Sealing Collar |
| 1149 | |
| 1150 | |
| 1151 | Round Mechanical Swing Arm Tract |
| 1152 | Bottom Sealing Lip |
| 1153 | |
| 1154 | |
| 1155 | |
| 1156 | |
| 1157 | Connector Swing Arm Tract |
| 1158 | Free End of Mechanical Wishbone Connector Points W, X, Y, Z |
| 1159 | Fixed End of Mechanical Wishbone Connector Points A, B, C, D |
| 1160 | |
| 1161 | |
| 1162 | Velcro |
| 1163 | Seat Bottom |
| 1164 | |
| 1165 | Extractor Jump Seat |
| 1166 | Seat Belt Harness |
| 1167 | Webbing Belt |
| 1168 | Seat Belt And Buckle |
| 1169 | Seat Hinge |
| 1170 | Discharge Port Cover |
| 1171 | Upper Connector |
| 1172 | Lower Connector |
| 1173 | |
| 1174 | |
| 1175 | Lock Collar |
| 1176 | |

What is claimed is:

1. A wild fire fighting water bucket "Rim Opening Device", which being mechanical, collapsible, symmetrical and polygonal in form and shape, is circumferentially disposed around and affixed inside the rim of the pliable, collapsible aerial wild fire fighting water bucket, which is dimensional as such to be suspended from a helicopter, and to be filled by dipping into an open body of water, the "Rim Opening Device" cooperating with the pliable side walls of the wild fire fighting water bucket to automatically open both concentrically when under tension from a helicopter and to automatically hold and lock open same, and to selectively accommodate manual collapse of both the Rim Opening Device and the pliable, collapsible wild fire fighting water bucket, the Rim Opening Device comprising:

(a) a plurality of interconnected mechanical wishbone apparatuses comprising;
  (i) interconnected, adjustable, mechanical swing arms,
  (ii) fixed end connectors,
  (iii) fixed end rotatable fasteners,
  (iv) free end connectors,
  (v) free end rotatable fasteners,
  (vi) fixed end of mechanical wishbones,
  (vii) free end of mechanical wishbones,
  (viii) a mechanical wishbone restrainer,
  all of which functionally cooperate with the pliable side walls of the collapsible wild fire water bucket to open, hold open or close same, (b) an angle of inclination which converts lifting tension to horizontal, concentric development of the Rim Opening Device, (c) a connector swing arm tract which guides the Rim Opening Device's concentric development, (d) a Rim Opening Device integrated weight differential system comprising;
  (i) a means for variably adjust the tipping weight to achieve rapid tipping and submersion of the wild fire fighting water bucket,
  (ii) a means for variably regulate the wild fire fighting water buckets in flight aerodynamics,
  (iii) a specific gravity weight differential system to achieve rapid tipping and submersion of the wild fire fighting water bucket, (e) vertically arranged, interconnected structural components of a collapsed Rim Opening Device, ie, the Mechanical Swing Arms, Fixed End Connectors, and the Free End Connectors embody design content and capacity to progressively transition perpendicularly therefrom into a defined horizontally arranged closed plane, symmetrical and polygonal in form and shape, having a centrally open orifice providing unrestricted access into the interior of the wild fire fighting water bucket.

2. A, Rim Opening Device, as claimed in claim 1, wherein the mechanical wishbones have both a fixed end of mechanical wishbone and a free end of mechanical wishbone which co-operate with mechanical swing arms rotatably affixed to both fixed end connectors and free end connectors and the pliable side walls to concentrically open the wild firefighting water bucket.

3. A, Rim Opening Device, as claimed in claim 2, wherein each of the fixed end connectors locate the fixed end of mechanical wishbones adjacent the wild fire fighting water buckets rim, the fixed end connectors comprising;

(a) connector swing arm tracts for receiving the mechanical swing arms, (b) An angle of inclination, (c) a means for rotationally connecting the mechanical swing arms, (d) a fixed end overcenter stop to co-operate with and eliminate overcentering the mechanical swing arms above the horizontal plane, (e) a lifting cord passageway, (f) a means to restrain the mechanical swing arms within the swing arm tract, (g) a means to interconnect the fixed end connectors with the mechanical swing arms, (h) a means to connect the fixed end connectors adjacent the rim of the bucket, (i) a means to connect the free end of mechanical wishbones to the first flexible tension links, all of which cooperatively guide the mechanical swing arm travel and the concentric development of the interconnected mechanical wishbones and the Rim Opening Device to open and close the wild fire fighting water bucket.

4. A, Rim Opening Device, as claimed in claim 3, wherein the fixed end connectors are located adjacent the bucket rim, the mechanical Rim Opening Device is aerodynamically dimensioned; leeward, therein, which co-operates with forward movement of the bucket during flight to produce a clear directional airflow above the bucket, not deflecting airflow therein.

5. A, Rim Opening Device, as claimed in claim 4, wherein the deployed Rim Opening Device co-operates aerodynamically with its dimensioned configuration within the centrally open top of the bucket to substantially reduce water loss during flight.

6. A, Rim Opening Device, as claimed in claim 2, wherein the free end of mechanical wishbone is defined by rotatably interconnecting the mechanical swing arms in pairs to the free end connectors, the free end connectors comprising;

(a) connector swing arm tracts for receiving the mechanical swing arms, (b) an angle of inclination, (c) a means for rotationally connecting the mechanical swing arms, (d) a free end overcenter stop to cooperate with and eliminate overcentering the mechanical swing arms above the horizontal plane, (e) a lifting cord passageway and a means to secure the lifting cord, (f) a means to connect the mechanical swing arms in pairs, all of which co-operatively guide the mechanical swing arm travel and the concentric development of the interconnected mechanical wishbones and the Rim Opening Device to open and close the wild fire fighting water bucket.

7. A, Rim Opening Device, as claimed in claim 1, wherein each mechanical wishbone has two mechanical swing arms, each comprising;

(a) are dimensioned as such to be received in connector swing arm tracts, (b) are dimensioned as such to receive slideable, adjustable trimming weights to adjust the aerodynamics of the wild fire fighting bucket, (c) are dimensioned as such to be rotatably connected to the fixed end connector, becoming the fixed end of mechanical wishbone, (d) are dimensioned as such to have the opposite end of the mechanical swing arm rotatably connected to the free end connector, becoming the free end of mechanical wishbone, (e) are dimensioned as such to be adjustable to length by means of mechanical swing arm adjusters, both left hand threaded and right hand threaded, which apply tension to the wild fire water bucket rim, all of which functionally co-operate with the pliable side wall to open the wild fire water bucket and adjust same for operational efficiency.

8. A, Rim Opening Device, as claimed in claim 7, wherein the length of the mechanical wishbone arms of the Rim Opening Device are adjustable.

9. A, Rim Opening Device, as claimed in claim 8, wherein the length of the mechanical swing arms adjustably co-operate with other structural members of the opening device, and the body of the bucket to circumferential tension the bucket rim.

10. A, Rim Opening Device, as claimed in claim 1, comprises a plurality of mechanical wishbones, being interconnected and dimensioned around the inside bucket rim, each of the mechanical wishbones comprising two mechanical swing arms rotatably connected to co-operate with the pliable side wall to open and close the bucket.

11. A, Rim Opening Device, as claimed in claim 10, wherein the plurality of mechanical wishbones each comprising a pair of mechanical swing arms, each having a fixed end of mechanical wishbone, and a free end of mechanical wishbone, each of the mechanical swing arm comprising; a fixed end connector, a mechanical swing arm, a free end connector and a means to rotationally connect said mechanical swing arms, all of which co-operate with the pliable side wall to open and close the bucket.

12. A, Rim Opening Device, as claimed in claim 10, wherein a plurality of the mechanical wishbones each comprises a pair of the mechanical swing arms which co-operate with the pliable side wall to open and close the bucket, the fixed end connectors comprising a means to rotatably connect the fixed ends of the mechanical swing arms adjacent the bucket rim.

13. A, Rim Opening Device, as claimed in claim 6, wherein the plurality of the mechanical wishbones each comprises a pair of mechanical swing arms which co-operate with the pliable side wall to open and close the bucket, the free end connectors have a means to rotatably connect the free ends of the mechanical swing arms in pairs.

14. A, Rim Opening Device, as claimed in claim 1, whereas the fixed end connectors and the free end connectors have similar angles of inclination, size and shape, the free end connector is installed upside down and rotated 180 degrees as to the fixed end connector to facilitate upward and concentric development of the Rim Opening Device.

15. A Rim Opening Device, as claimed in claim 1, wherein the ballasting means to achieve a fast tipping action and submersion while filling is accomplished by an integrated weight differential on opposite sides of the Rim Opening Device; the deployed plurality of interconnected mechanical wishbones, the fixed end connectors, the swing arms and the free end connectors have a higher specific gravity quotient or are heavier on one side of the Rim Opening Device than on the other creating the ballasted weight differential system which promotes fast tipping and submersion.

16. A, Rim Opening Device, as claimed in claim 15, wherein the tipping weight differential is dimensioned over about a 180 degree arc located adjacent the rim to achieve a torquing, quick tipping action and fast submersion during filling.

17. A, Rim Opening Device, as claimed in claim 15, wherein the perimeter of the pliable rim is circumferentially and structurally supported by the weighted, deployed open, Rim Opening Device which co-operates with the tipping action to knife the leading edge underwater, facilitating rapid submersion and filling.

18. A, Rim Opening Device, as claimed in claim 15, wherein the ballasting means to achieve rapid submersion during filling is structurally integral to the bucket's mechanical Rim Opening Device.

19. A, Rim Opening Device, as claimed in claim 15, wherein the ballasting means to achieve a quick tipping action is arranged circumferentially and horizontally adjoined in union with, conterminous with, and contiguous with the buckets uppermost extremity, its rim, to maximize the ballasts Metacentric Height, thereby densely concentrating the gravitational tipping moment at the buckets upper rim.

20. A, Rim Opening Device, claimed in claim 15, wherein the Metacentric Height of the ballast is consistent with the buckets maximum gravitational tipping moment.

21. A, Rim Opening Device, as claimed in claim 1, wherein the deployed Rim Opening Device opens concentrically to define a structurally unrestricted centrally open round mouth which co-operates with the bucket body to receive general cargo.

22. A, Rim Opening Device, as claimed in claim 15, wherein centers of the circumferentially arranged tipping weights are in a vertically aligned plane when the bucket has been tipped horizontally, maximizing the downwardly force, to c-operate with the circumferentially tensioned rim of the bucket, to achieve quick submersion and filling.

23. A, Rim Opening Device, as claimed in claim 1, wherein the deployed Rim Opening Device opens up concentrically to define a structurally unrestricted centrally open, essentially round mouth to co-operate with the bucket body to receive emergency evacuees, a flip down, pliable, emergency extractor jump seat and a seat belt harness co-operating to secure the evacuees for extraction from harms way.

24. A, Rim Opening Device, as claimed in claim 1, wherein the Rim Opening Device has a lifting cord attached to the free end connector, when tension is applied there to, the mechanical wishbones transitions from a closed vertical plane to a horizontal plane concentrically in co-operation with the pliable side wall to open the bucket.

25. A, Rim Opening Device, as claimed in claim 1, wherein the first flexible tension links, a plurality of suspension lines co-operates with the Rim Opening Device lifting cords to lift the Rim Opening Device into the deployed horizontal position while not placing bucket weight on the Rim Opening Device or its lifting cords.

26. A, Rim Opening Device, as claimed in claim 1, wherein each of the fixed end and the free end connectors have an angle of inclination which produces a concentric outward development of the Rim Opening Device when tension is applied to the lifting cords.

27. A, Rim Opening Device, as claimed in claim 1, wherein the Rim Opening Device lifting cords have a means to hold open the bucket against the weighted wishbone arms which could collapse the bucket unexpectedly, when tension on the first flexible tension links is released.

* * * * *